US012728971B2

(12) United States Patent
Chen et al.

(10) Patent No.: US 12,728,971 B2
(45) Date of Patent: Sep. 8, 2026

(54) UNDERWATER DEVICE

(71) Applicant: Pioneer Material Precision Tech Co., Ltd., New Taipei City (TW)

(72) Inventors: Chih-Sheng Chen, New Taipei City (TW); Ching-Hung Liu, New Taipei City (TW)

(73) Assignee: Pioneer Material Precision Tech Co., Ltd., New Taipei City (TW)

( * ) Notice: Subject to any disclaimer, the term of this patent is extended or adjusted under 35 U.S.C. 154(b) by 234 days.

(21) Appl. No.: 18/822,426

(22) Filed: Sep. 2, 2024

(65) Prior Publication Data

US 2026/0042521 A1 Feb. 12, 2026

(30) Foreign Application Priority Data

Aug. 12, 2024 (CN) ..... 202421933440.8

(51) Int. Cl.

| | |
|---|---|
| ***B63G 8/14*** | (2006.01) |
| ***B63G 8/00*** | (2006.01) |
| ***B63G 8/04*** | (2006.01) |
| ***B63G 8/38*** | (2006.01) |

(52) U.S. Cl.

CPC ..... *B63G 8/14* (2013.01); *B63G 8/001* (2013.01); *B63G 8/04* (2013.01); *B63G 8/38* (2013.01); *B63G 2008/002* (2013.01)

(58) Field of Classification Search

CPC . B63G 8/001; B63G 8/04; B63G 8/14; B63G 8/38; B63G 2008/002

See application file for complete search history.

(56) References Cited

U.S. PATENT DOCUMENTS

| | | | | |
|---|---|---|---|---|
| 2,936,729 A * | 5/1960 | Kuttner | ..... | B63H 1/36 440/15 |
| 6,138,604 A * | 10/2000 | Anderson | ..... | B63G 8/08 440/15 |
| 6,619,146 B2 * | 9/2003 | Kerrebrock | ..... | F16H 21/52 74/25 |

(Continued)

FOREIGN PATENT DOCUMENTS

| | | | | |
|---|---|---|---|---|
| CN | 107310705 A | 11/2017 | | |
| CN | 113525638 B * | 4/2022 | ..... | B63G 8/26 |

(Continued)

*Primary Examiner* — S. Joseph Morano
*Assistant Examiner* — Jovon E Hayes
(74) *Attorney, Agent, or Firm* — Winston Hsu

(57) ABSTRACT

An underwater device includes a main body and a center of gravity mechanism. The center of gravity mechanism is disposed in the main body. The center of gravity mechanism includes a fixing plate, a bracket, a first driving motor, two guiding rods, two linear bearings, a battery module and a transmission assembly. The bracket is fixed to the fixing plate. The first driving motor is disposed on the bracket. The two guiding rods are fixed at two sides of the fixing plate. The two linear bearings are disposed on the two guiding rods. The battery module is connected to the two linear bearings. The transmission assembly is connected to the first driving motor and the battery module. The first driving motor drives the battery module to move along the two guiding rods through the transmission assembly to shift a center of gravity of the underwater device.

19 Claims, 22 Drawing Sheets

(56) References Cited

U.S. PATENT DOCUMENTS

| | | | | |
|---|---|---|---|---|
| 6,814,634 | B2 * | 11/2004 | Roberts | B63H 11/08 440/38 |
| 6,835,108 | B1 * | 12/2004 | Gieseke | B63H 1/30 440/14 |
| 8,322,296 | B2 * | 12/2012 | Tiraby | B63G 8/20 114/337 |
| 9,937,986 | B1 * | 4/2018 | Oh | B63G 8/001 |
| 2015/0120045 | A1 * | 4/2015 | Tan | B63G 8/001 700/250 |
| 2018/0312234 | A1 * | 11/2018 | Garthwaite | B63C 11/46 |
| 2019/0100294 | A1 * | 4/2019 | Xiong | B63C 11/52 |
| 2021/0276678 | A1 * | 9/2021 | Yao | B63G 8/001 |
| 2022/0033043 | A1 * | 2/2022 | Garthwaite | B63H 1/36 |
| 2023/0013643 | A1 * | 1/2023 | Wan | B63G 8/22 |
| 2025/0002129 | A1 * | 1/2025 | Chen | B63G 8/001 |
| 2025/0236371 | A1 * | 7/2025 | Song | B63H 1/36 |

FOREIGN PATENT DOCUMENTS

| | | | | | |
|---|---|---|---|---|---|
| CN | 216580945 | U | | 5/2022 | |
| CN | 114954863 | B | * | 9/2024 | B63G 8/39 |
| CN | 119568377 | A | * | 3/2025 | G01C 11/00 |
| CN | 119568454 | A | * | 3/2025 | B64U 30/12 |
| CN | 116331453 | B | * | 8/2025 | B63G 8/38 |
| DE | 202024102869 | U1 | * | 7/2024 | B63G 8/14 |
| EP | 1 134 011 | A2 | | 9/2001 | |
| KR | 10-1268239 | B1 | | 5/2013 | |
| TW | I831709 | B | | 2/2024 | |
| TW | M654657 | U | | 4/2024 | |
| TW | I852618 | B | | 8/2024 | |

* cited by examiner

UNDERWATER DEVICE

BACKGROUND OF THE INVENTION

1. Field of the Invention

The invention relates to an underwater device and, more particularly, to an underwater device capable of being applied to a bionic fish.

2. Description of the Prior Art

At present, a conventional bionic fish uses a counterweight to control the center of gravity to achieve control of floating and diving. The mechanical design is usually complex and affects the smoothness and reliability of operation. A mechanism that is too complex will increase friction and reduce the life of a driving mechanism. Furthermore, waterproof structures also require special design. In order to meet waterproof requirements, some designs will use a waterproof motor. However, the cost of a waterproof motor is usually much higher than that of a non-waterproof motor.

SUMMARY OF THE INVENTION

The invention provides an underwater device capable of being applied to a bionic fish, so as to solve the aforesaid problems.

According to an embodiment of the invention, an underwater device comprises a main body and a center of gravity mechanism. The center of gravity mechanism is disposed in the main body. The center of gravity mechanism comprises a fixing plate, a bracket, a first driving motor, two guiding rods, two linear bearings, a battery module and a transmission assembly. The bracket is fixed to the fixing plate. The first driving motor is disposed on the bracket. The two guiding rods are fixed at two sides of the fixing plate. The two linear bearings are disposed on the two guiding rods. The battery module is connected to the two linear bearings. The transmission assembly is connected to the first driving motor and the battery module. The first driving motor drives the battery module to move along the two guiding rods through the transmission assembly to shift a center of gravity of the underwater device.

In an embodiment, the transmission assembly comprises a crank, a linkage rod and a transition plate, the crank is connected to the first driving motor, the transition plate is connected to the battery module, and the linkage rod is connected to the crank and the transition plate.

In an embodiment, the battery module comprises a battery box, a battery and a baffle, the transmission assembly is connected to the battery box, the battery is disposed in the battery box, and the baffle is fixed to an end of the battery box to restrain the battery in the battery box.

In an embodiment, the underwater device is a bionic fish, a fish head section of the main body comprises a first casing, a second casing, a third casing, a first sealing ring, a second sealing ring, a first fixing frame, a second fixing frame and a third fixing frame, the first sealing ring is sandwiched between the first casing and the second casing, the second sealing ring is sandwiched between the second casing and the third casing, the first fixing frame is configured to fix the first casing and the second casing, the second fixing frame and the third fixing frame are configured to fix the second casing and the third casing, and the center of gravity mechanism is disposed in the second casing.

In an embodiment, the second sealing ring has an outer flange, an inner flange and a first recess, the first recess is located between the outer flange and the inner flange, the second casing has a second recess, the third casing has a boss, the second sealing ring is embedded in the second recess, the boss is embedded in the first recess, and the outer flange and the inner flange are sandwiched between the second casing and the third casing.

In an embodiment, the second casing has a first protruding portion, the third casing has a second protruding portion, the first protruding portion abuts against the second protruding portion, the second fixing frame abuts against the first protruding portion, the third fixing frame abuts against the second protruding portion, a fixing member sequentially passes through the second fixing frame, the first protruding portion, the second protruding portion and the third fixing frame to fix the second casing and the third casing, and the second sealing ring is closer to an inside of the second casing and the third casing than the fixing member.

In an embodiment, the underwater device further comprises four infrared sensors disposed in the first casing, wherein positions of the four infrared sensors correspond to front, bottom, left and right sides of the main body respectively.

In an embodiment, the underwater device further comprises a camera lens disposed in the first casing and located above the four infrared sensors.

In an embodiment, the underwater device further comprises a fish eye cover and a fixing sheet, wherein the fish eye cover is disposed on the second casing and has a fixing flange, and the fixing flange is sandwiched between the fixing sheet and the second casing.

In an embodiment, a fish body section of the main body comprises a fourth casing, a fifth casing, a sixth casing, a first fixing base and a first driving mechanism, the fourth casing is fixed to the third casing, the first fixing base is fixed to the third casing, the fifth casing is pivotally connected to the first fixing base, the sixth casing is fixed to the first fixing base, the first driving mechanism is disposed in the fifth casing and connected to the fourth casing, and the first driving mechanism is configured to drive the fifth casing to rotate with respect to the fourth casing and the sixth casing.

In an embodiment, the first driving mechanism comprises a second driving motor, a first adapter, a second adapter, a transmission shaft, a shaft sleeve and a connecting member, the first adapter is connected to the second driving motor, the second adapter is connected to the first adapter, the transmission shaft is connected to the second adapter and the connecting member, the connecting member is connected to the fourth casing, and the shaft sleeve is sleeved on the transmission shaft.

In an embodiment, the first driving mechanism further comprises a bearing, a spacer, a third sealing ring and a fourth sealing ring, the bearing, the spacer, the third sealing ring and the fourth sealing ring are sleeved on the shaft sleeve, the third sealing ring is sandwiched between the shaft sleeve and the fourth casing, and the fourth sealing ring is sandwiched between the spacer and the fifth casing.

In an embodiment, the first driving mechanism further comprises a first support member and a second support member, the second driving motor is fixed to the first support member, the first support member is connected to the second support member, and the second support member is connected to the fifth casing.

In an embodiment, the fish body section of the main body comprises a seventh casing, an eighth casing, a ninth casing, a tenth casing, a second fixing base and a second driving mechanism, the seventh casing is fixed to the fifth casing, the eighth casing is fixed to the seventh casing, the second fixing base is fixed to the seventh casing, the ninth casing is pivotally connected to the second fixing base, the tenth casing is connected to the second fixing base, the second driving mechanism is disposed in the ninth casing and connected to the eighth casing, and the second driving mechanism is configured to drive the ninth casing to rotate with respect to the eighth casing and the tenth casing.

In an embodiment, the underwater device further comprises an eleventh casing and a wireless communication module, wherein the eleventh casing is connected to the ninth casing, and the wireless communication module is disposed in the eleventh casing and fixed to the second driving mechanism.

In an embodiment, the underwater device further comprises a fixing structure and a fish tail, wherein the fixing structure is fixed to the eleventh casing, and the fish tail is fixed to the fixing structure.

In an embodiment, the underwater device further comprises an outer cover and a fish fin, wherein the outer cover is sleeved on an outside of the main body and has an engaging hole, the fish fin has an I-shaped engaging structure, and the I-shaped engaging structure is engaged in the engaging hole to fix the fish fin to the outer cover.

In an embodiment, an avoidance space is formed between the outer cover and the main body.

In an embodiment, the underwater device further comprises an anti-loosening component and a screw, wherein the outer cover has an installation hole and a plurality of first restraining holes, the main body has a screw hole and a plurality of second restraining holes, the anti-loosening component has a through hole and a plurality of restraining portions, the plurality y of restraining portions sequentially passes through the plurality of first restraining holes and the plurality of second restraining holes to install the anti-loosening component in the installation hole, and the screw passes though the through hole to be fixed to the screw hole.

As mentioned in the above, the invention utilizes the first driving motor of the center of gravity mechanism to drive the battery module to move to shift the center of gravity of the underwater device, so as to achieve control of floating and diving. Since the battery module moves along the guiding rod through the linear bearing, the linear movement of the battery module becomes very smooth, such that the load of the first driving motor becomes smaller and more stable, thereby reducing the failure rate of the first driving motor. The invention may achieve waterproof requirements through the arrangement of multiple sealing rings. In an embodiment, the underwater device may be a bionic fish. The driving mechanism is equipped with the bearing, the spacer and the sealing ring on the shaft sleeve, which allows the fish body section of the bionic fish to rotate smoothly and waterproof. In an embodiment, the positions of four infrared sensors correspond to the front, bottom, left and right sides of the main body respectively, such that the four infrared sensors may be configured to detect obstacles in front, left and right of the underwater device and detect whether the underwater device has dived to the bottom.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
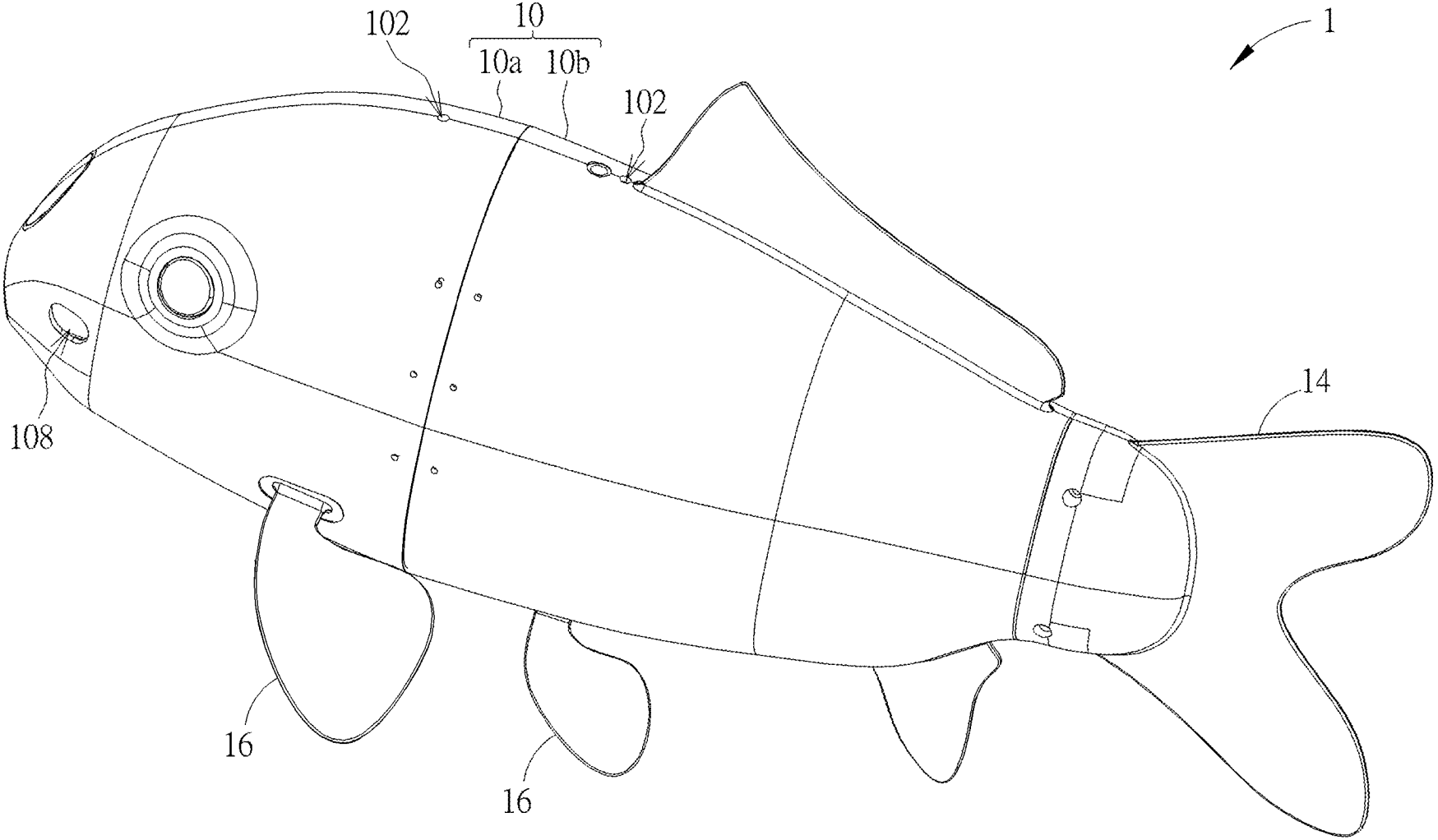
FIG. 1 is a perspective view illustrating an underwater device according an embodiment of the invention.
Figure 2:
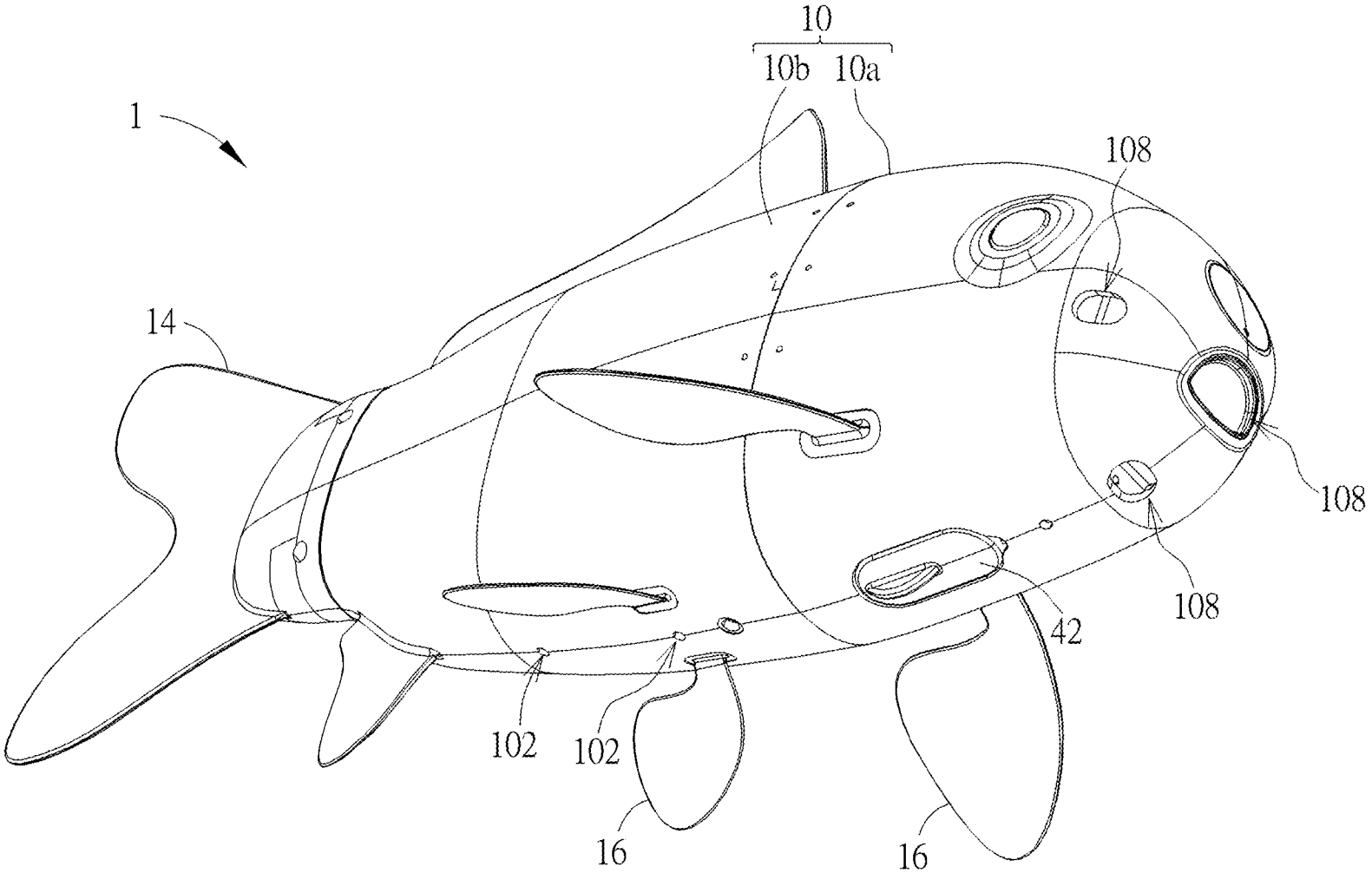
FIG. 2 is a perspective view illustrating the underwater device shown in FIG. 1.
Figure 3:
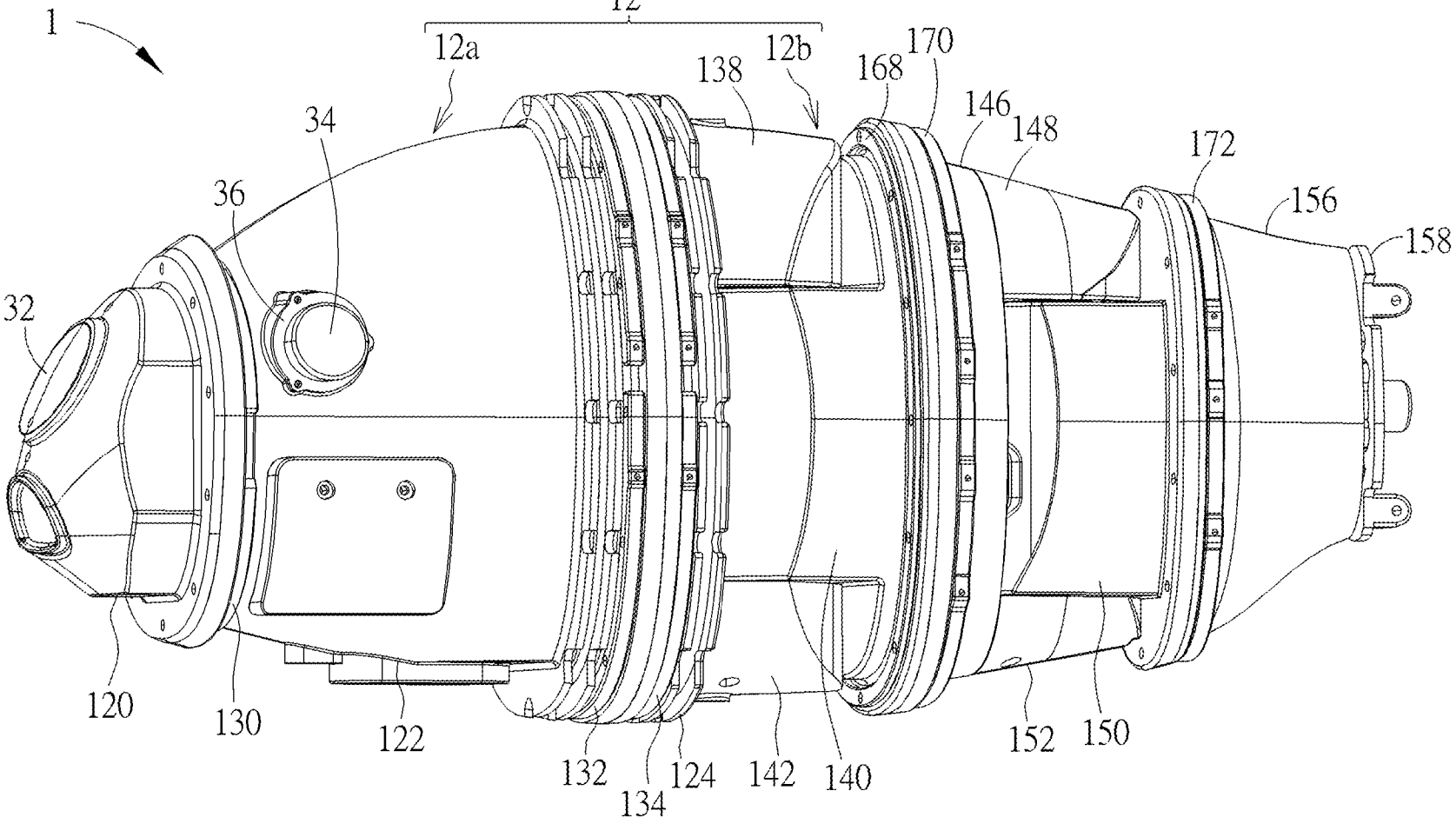
FIG. 3 is a perspective view illustrating the underwater device shown in FIG. 1 without an outer cover.
Figure 4:
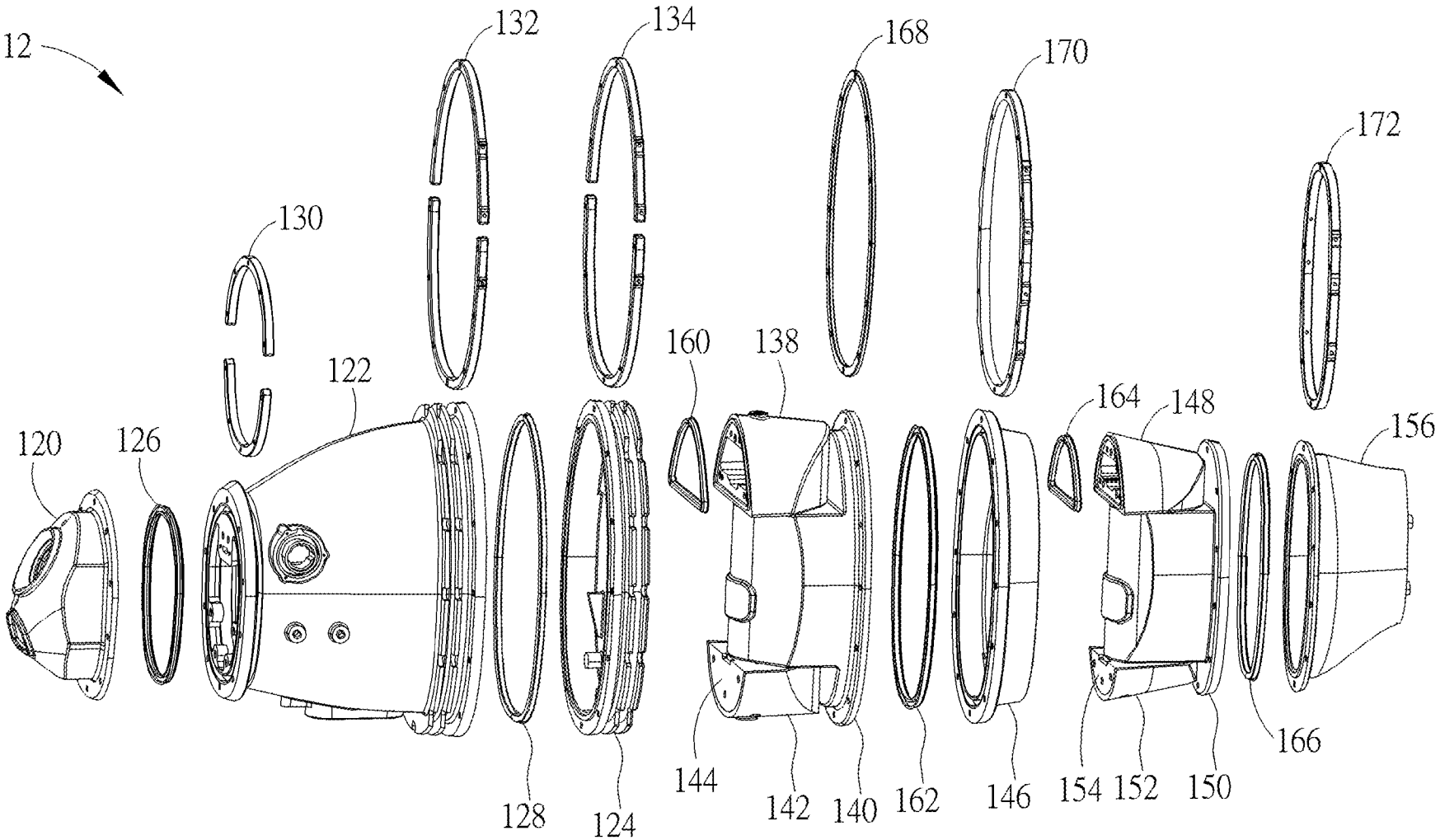
FIG. 4 is an exploded view illustrating a main body shown in FIG. 3.
Figure 5:
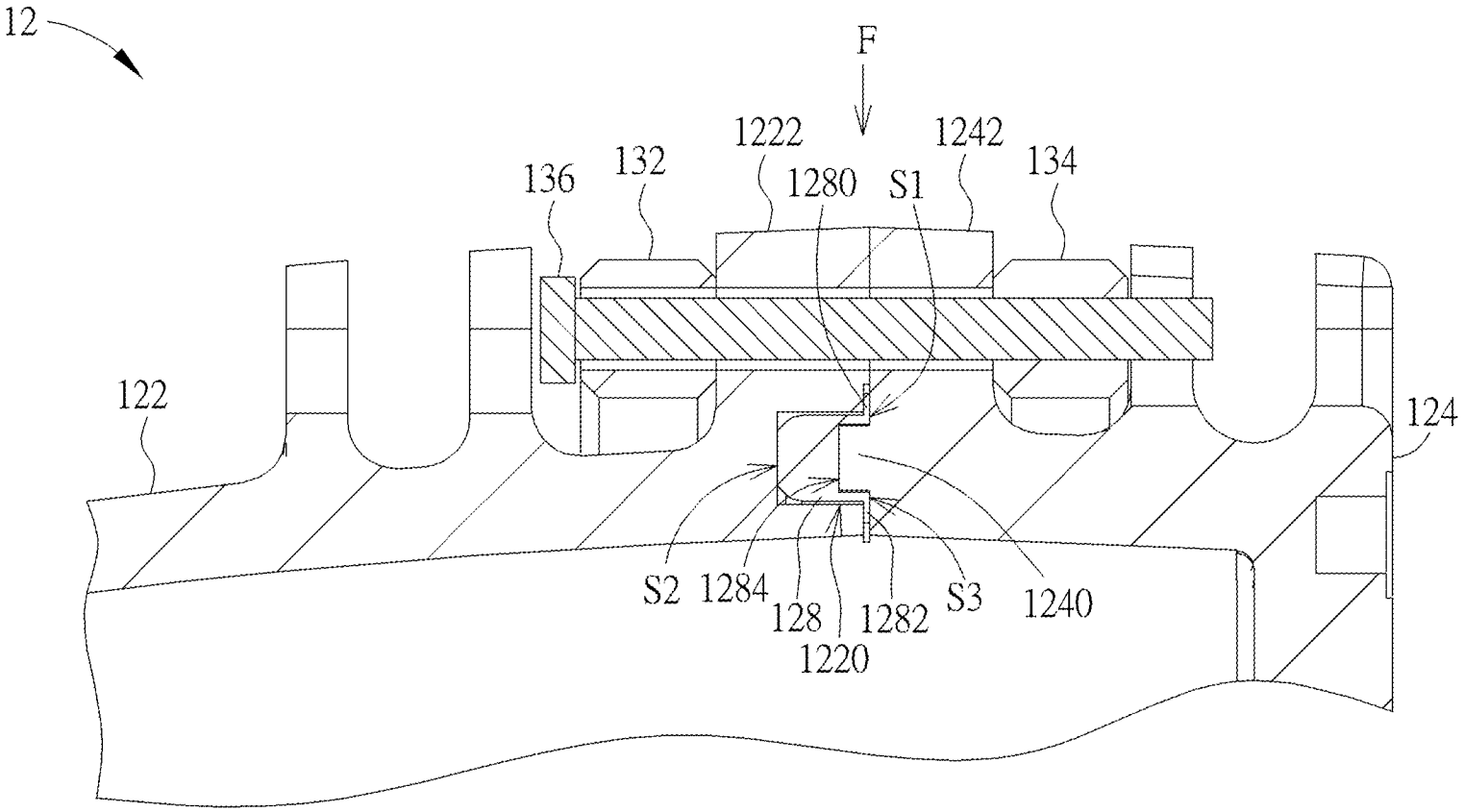
FIG. 5 is a partial sectional view illustrating the main body shown in FIG. 3.
Figure 6:
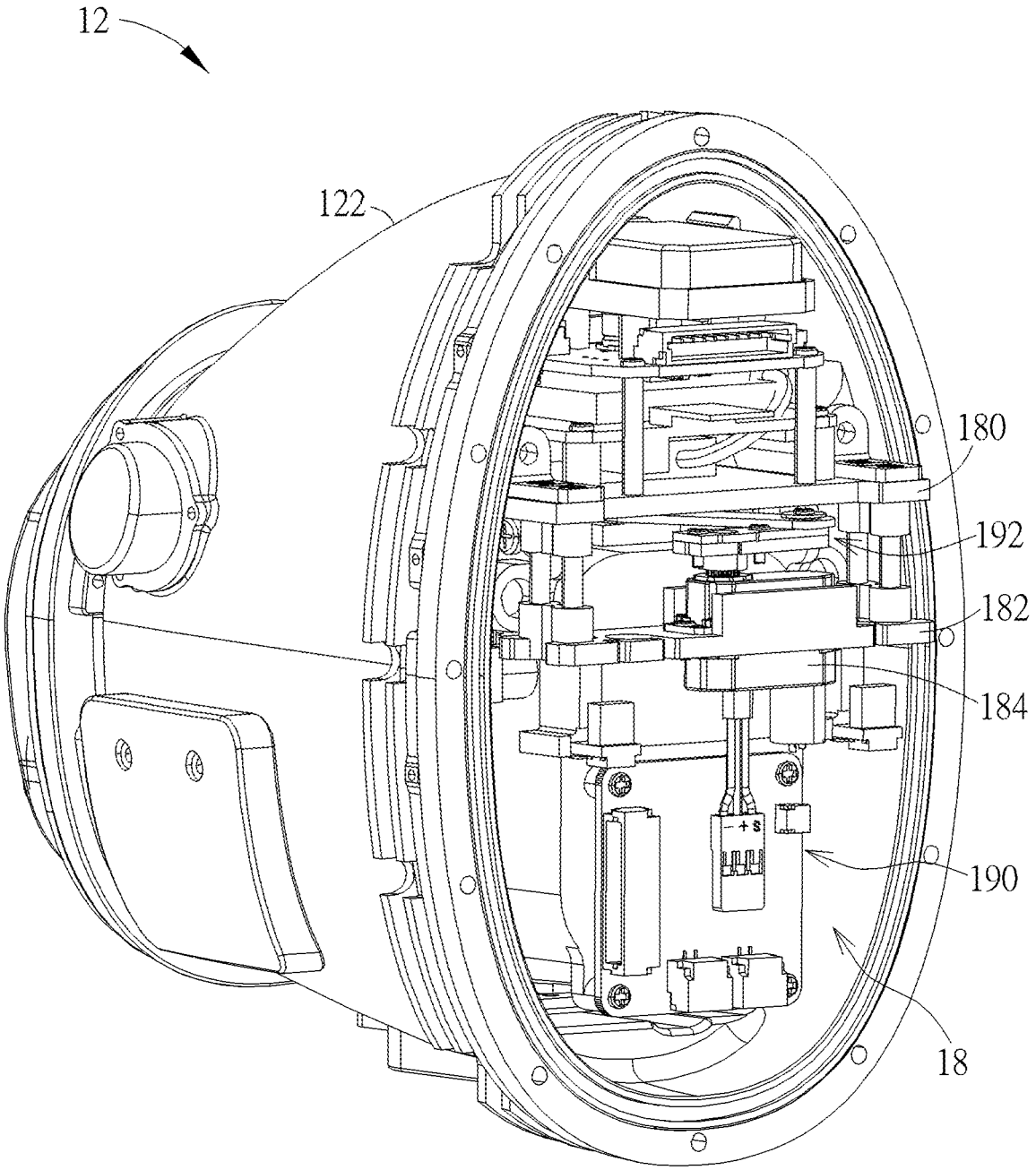
FIG. 6 is a partial perspective view illustrating the main body shown in FIG. 3 from another viewing angle.
Figure 7:
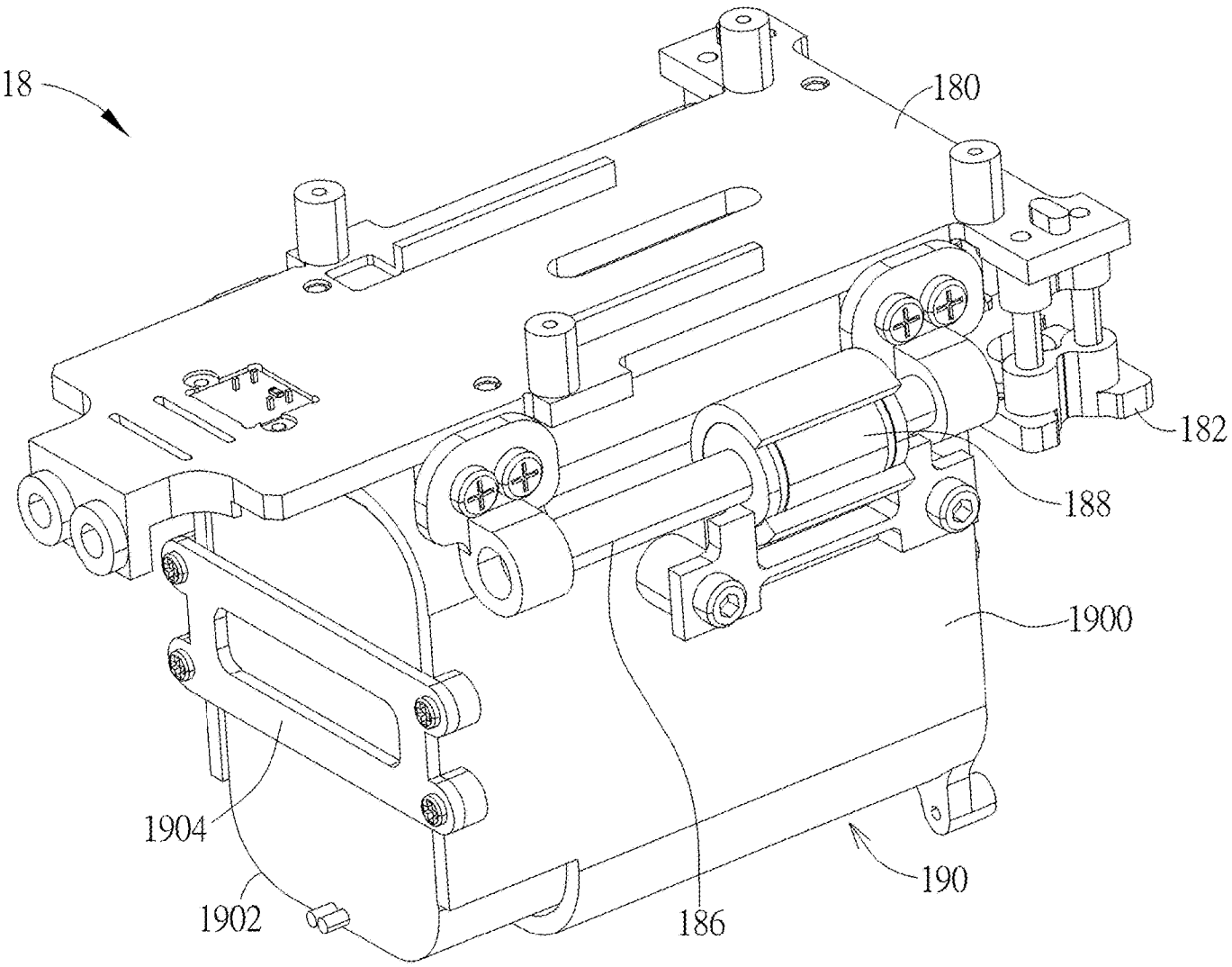
FIG. 7 is a perspective view illustrating a center of gravity mechanism shown in FIG. 6.
Figure 8:
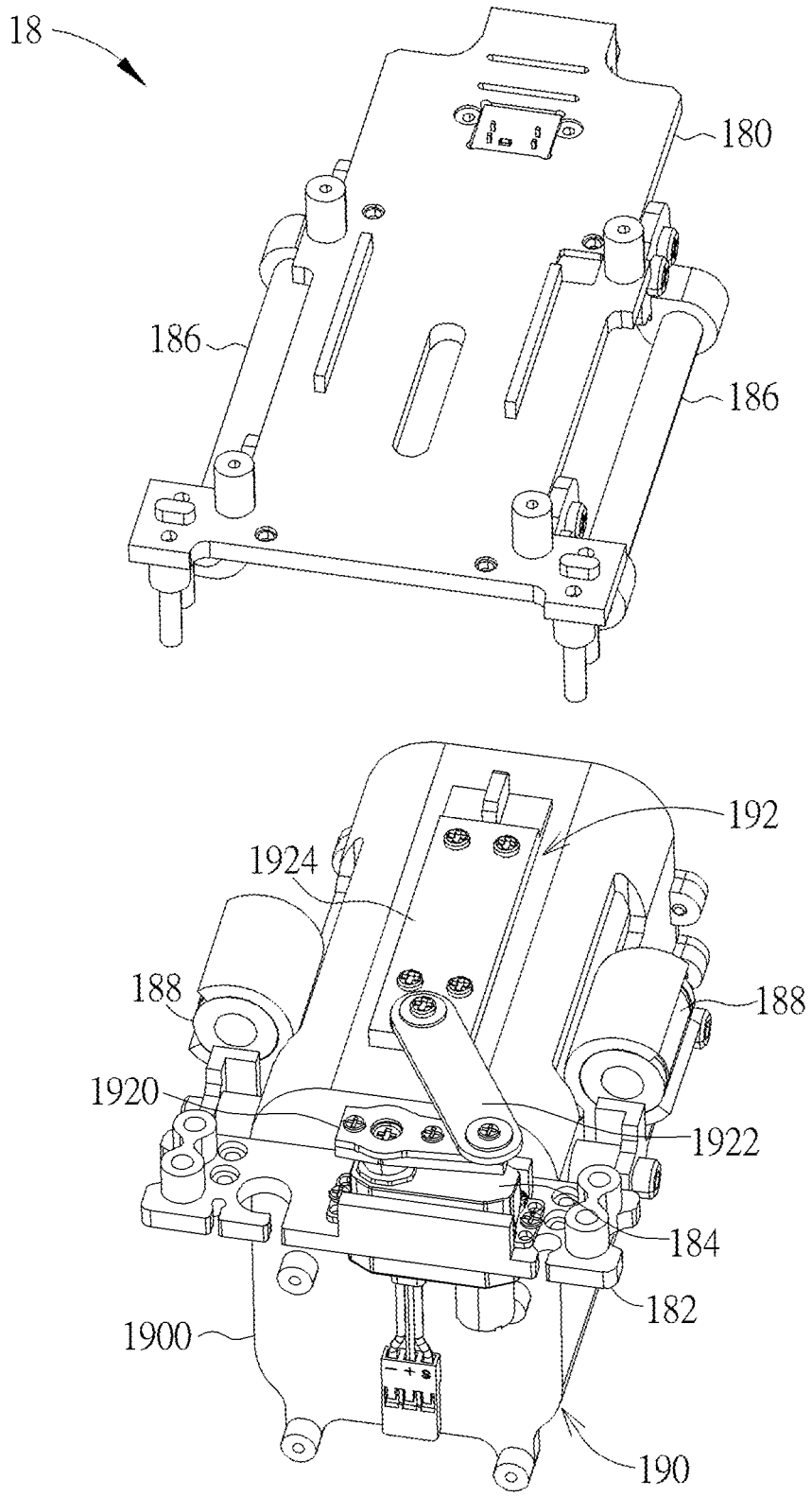
FIG. 8 is a partial exploded view illustrating the center of gravity mechanism shown in FIG. 7.
Figure 9:
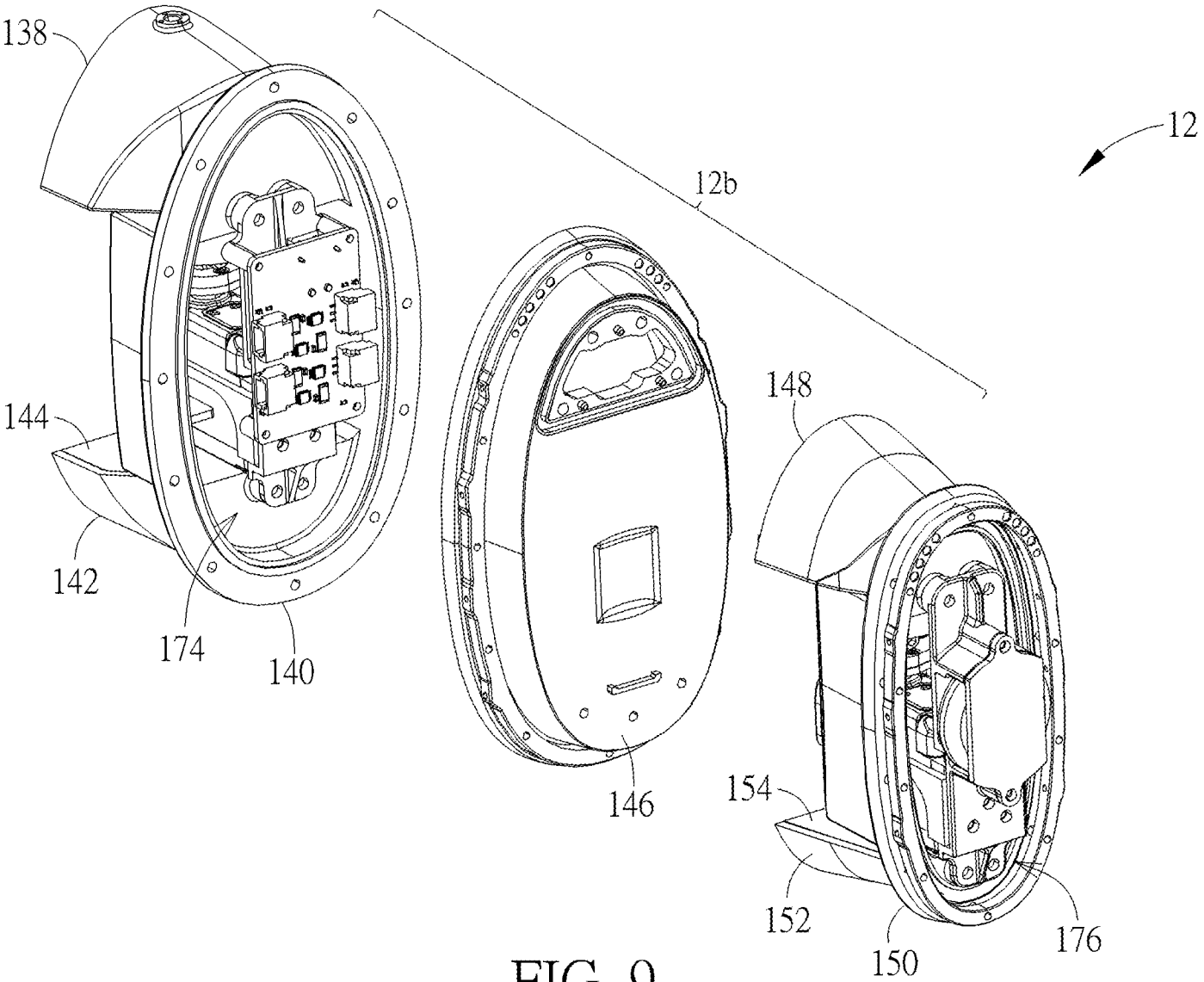
FIG. 9 is a partial perspective view illustrating the main body shown in FIG. 3 from another viewing angle.
Figure 10:
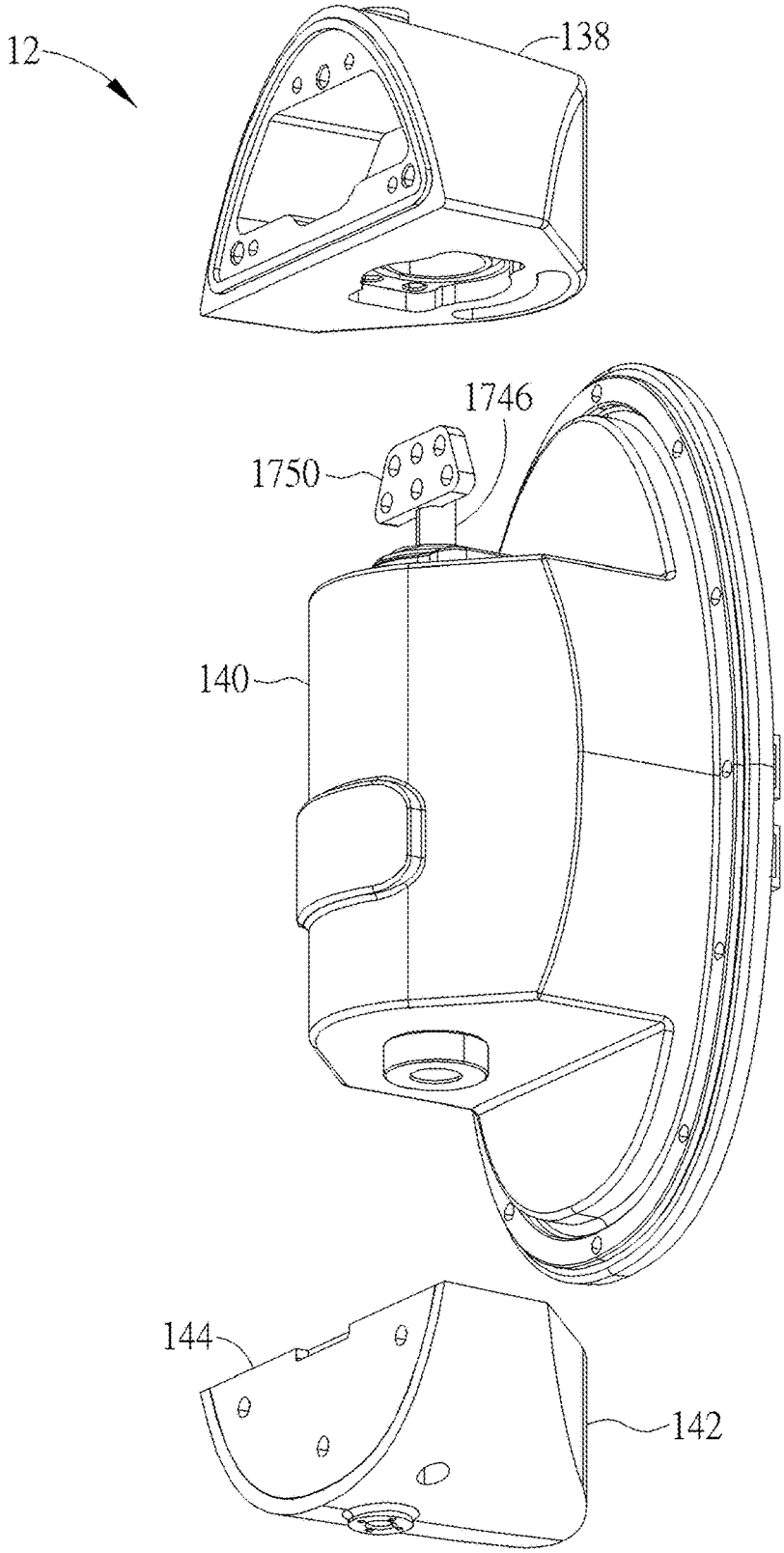
FIG. 10 is a partial exploded view illustrating the main body shown in FIG. 9 from another viewing angle.
Figure 11:
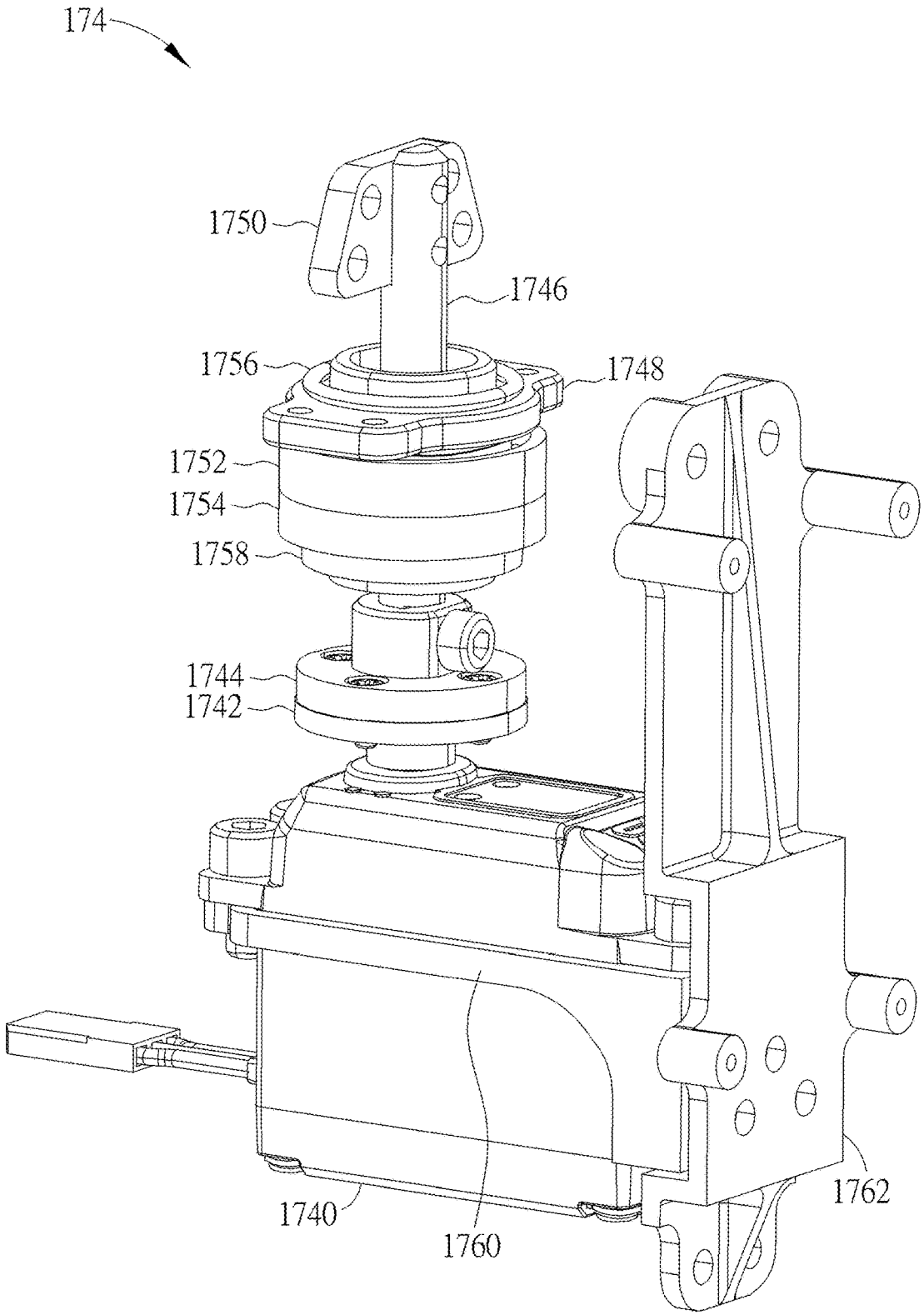
FIG. 11 is a perspective view illustrating a first driving mechanism shown in FIG. 9.
Figure 12:
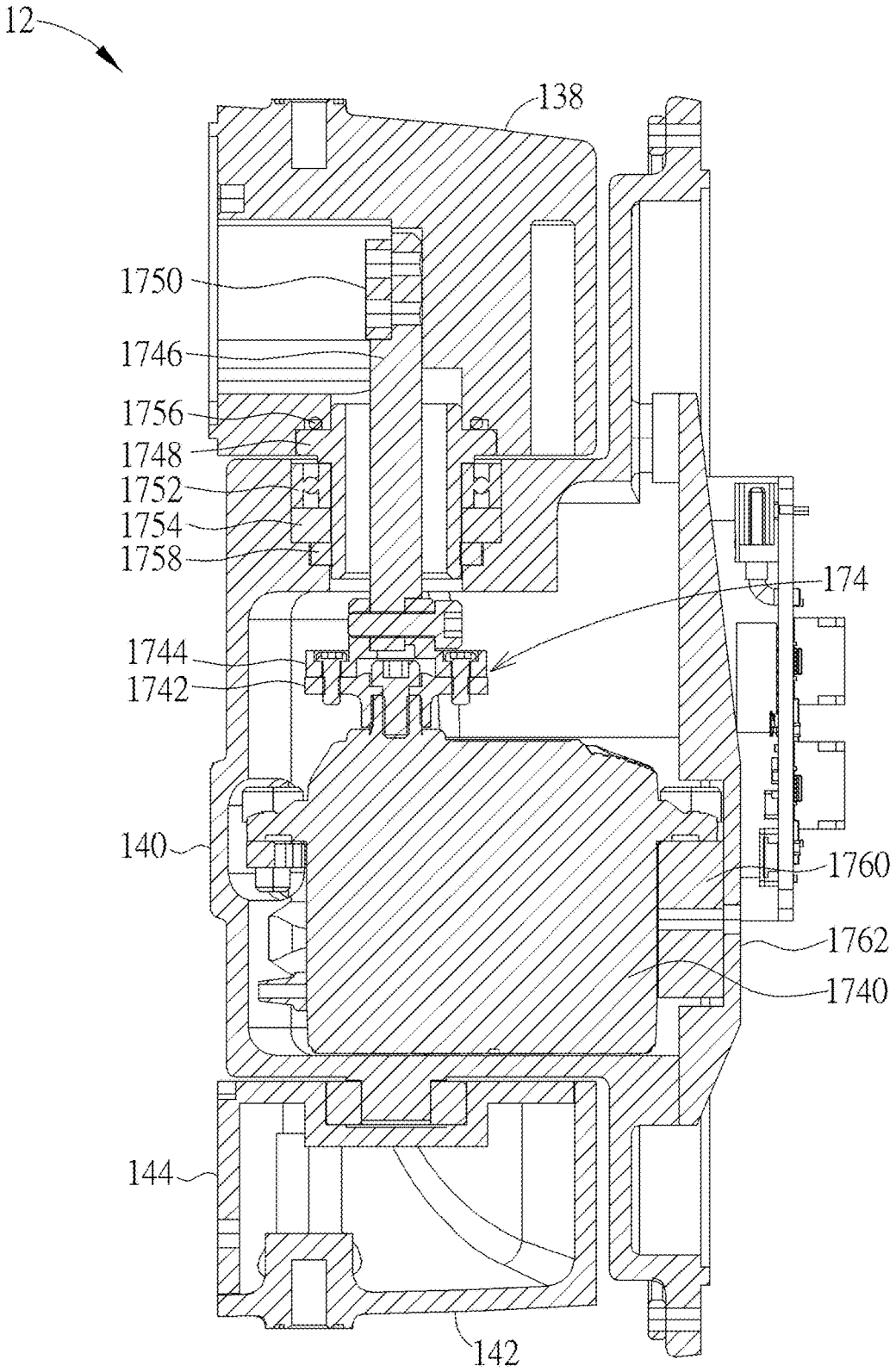
FIG. 12 is a partial sectional view illustrating the main body shown in FIG. 9.
Figure 13:
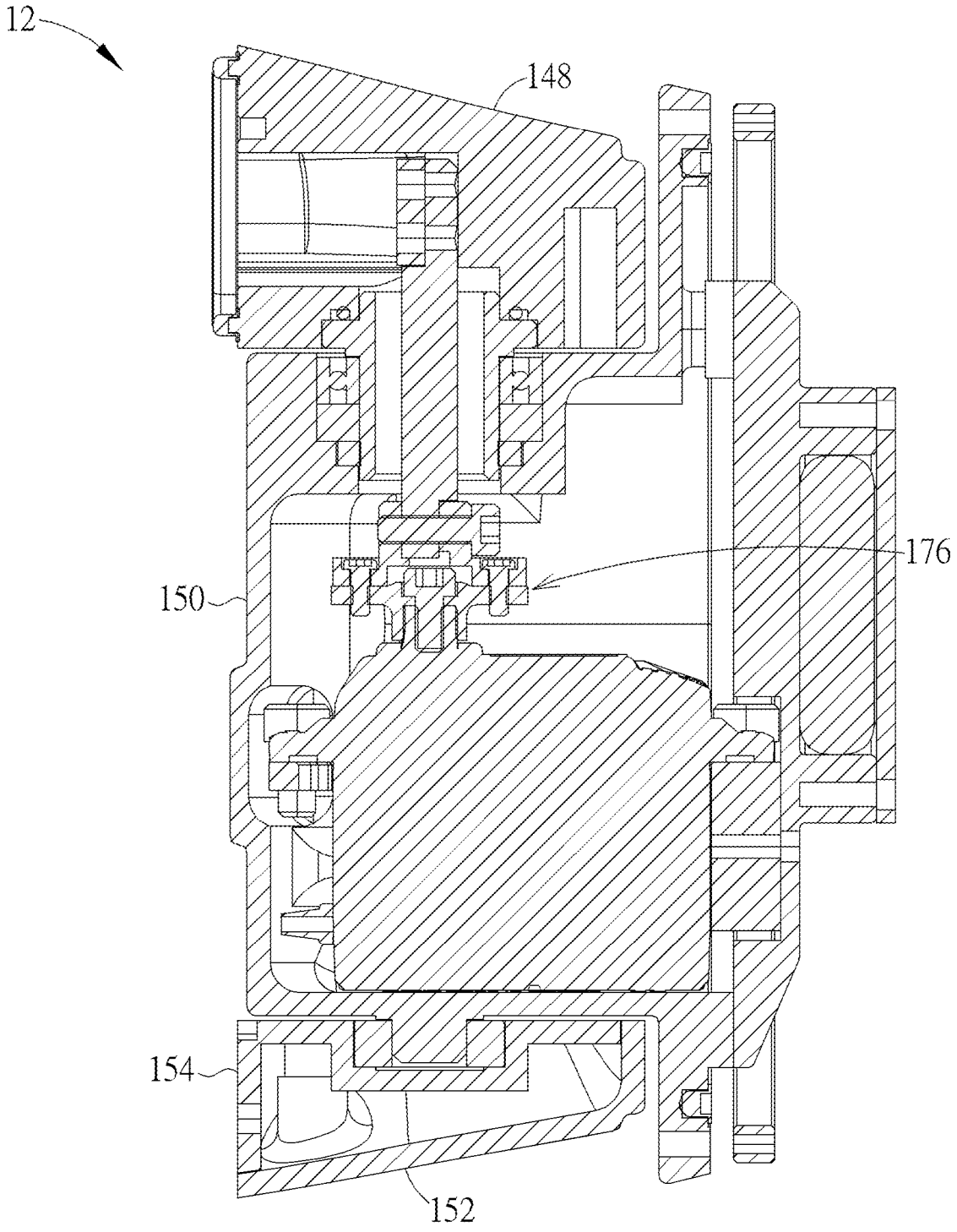
FIG. 13 is another partial sectional view illustrating the main body shown in FIG. 9.
Figure 14:
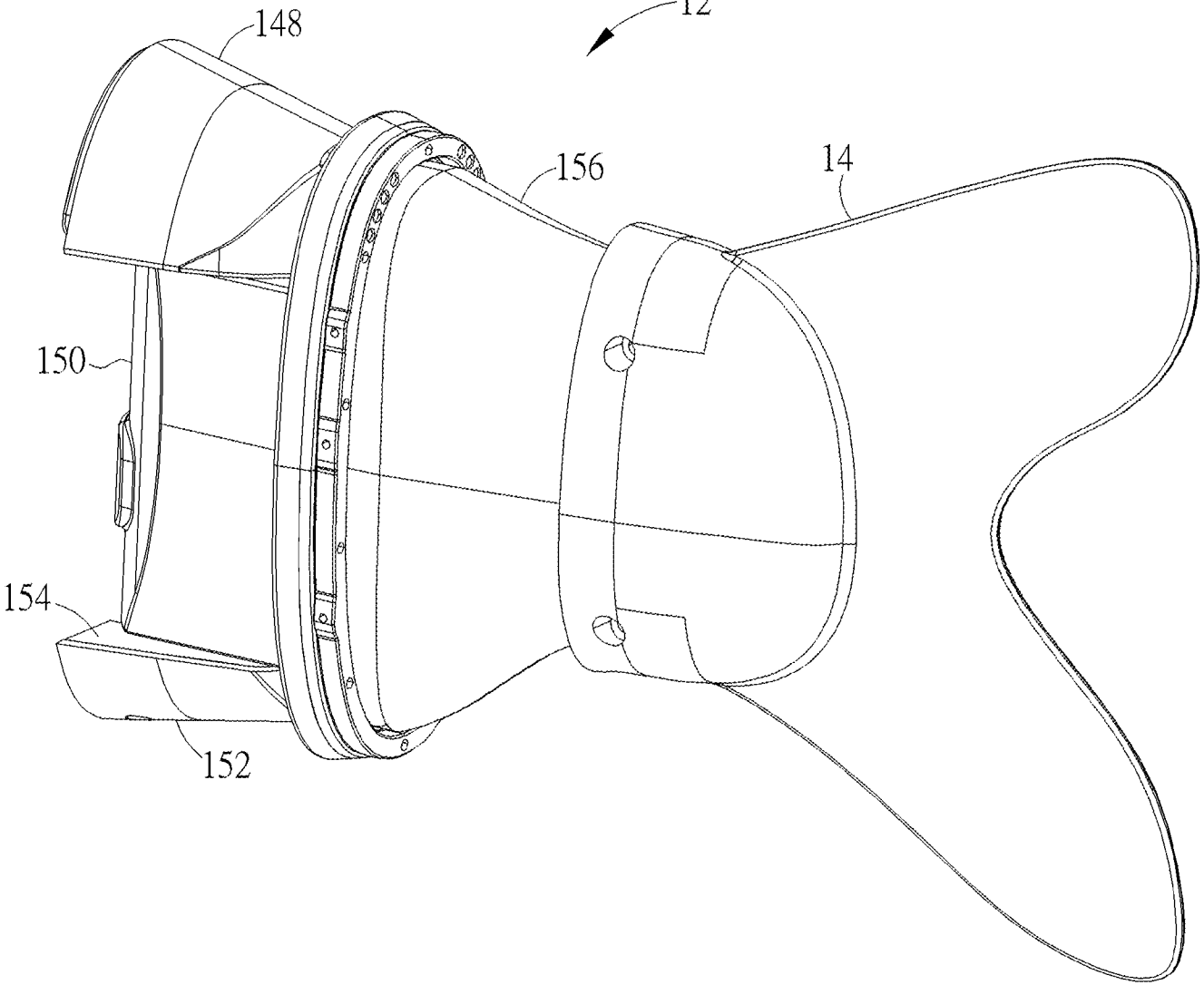
FIG. 14 is a perspective view illustrating the main body shown in FIG. 3 connected with a fish tail.
Figure 15:
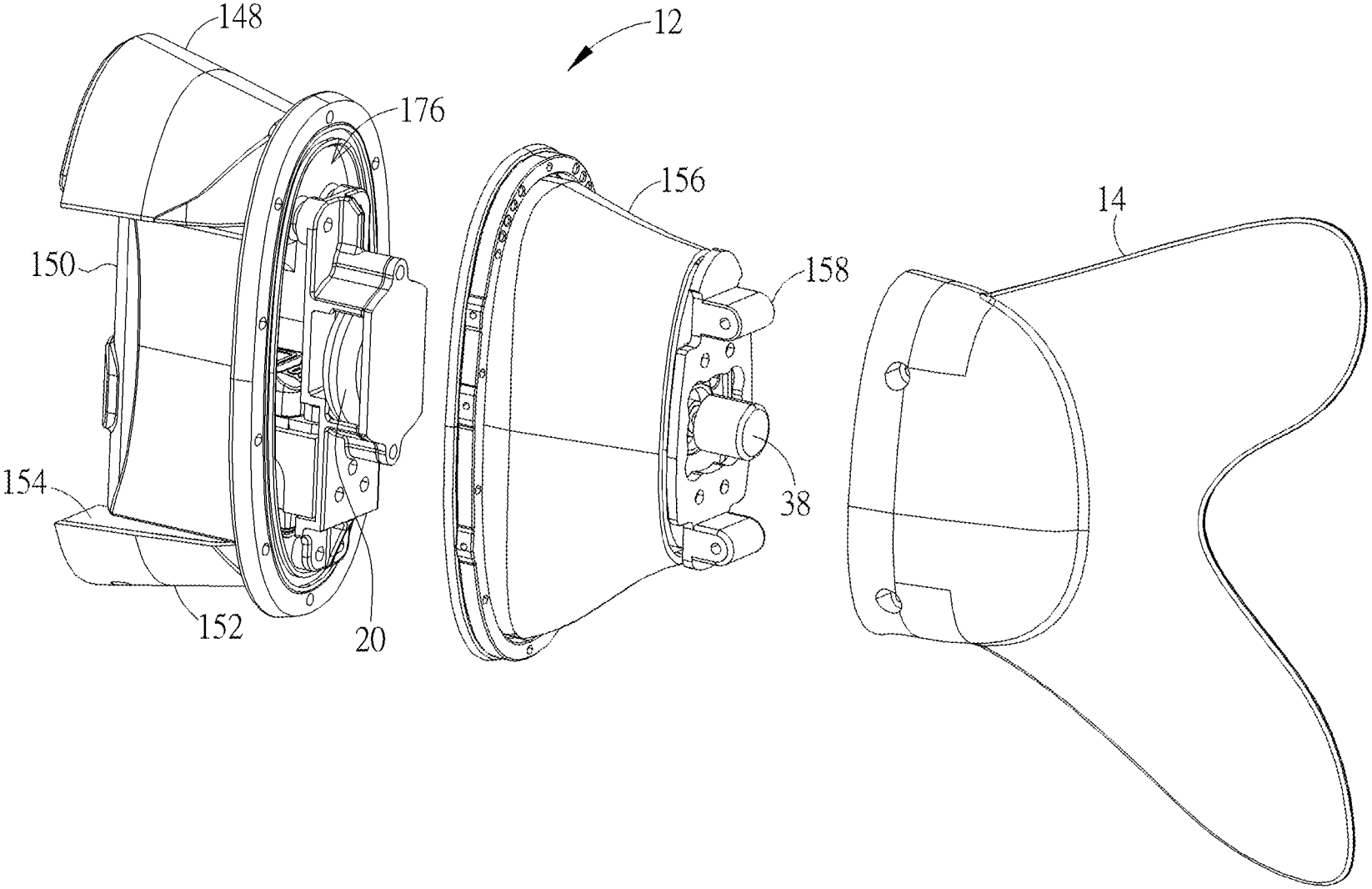
FIG. 15 is an exploded view illustrating the main body and the fish tail shown in FIG. 14.
Figure 16:
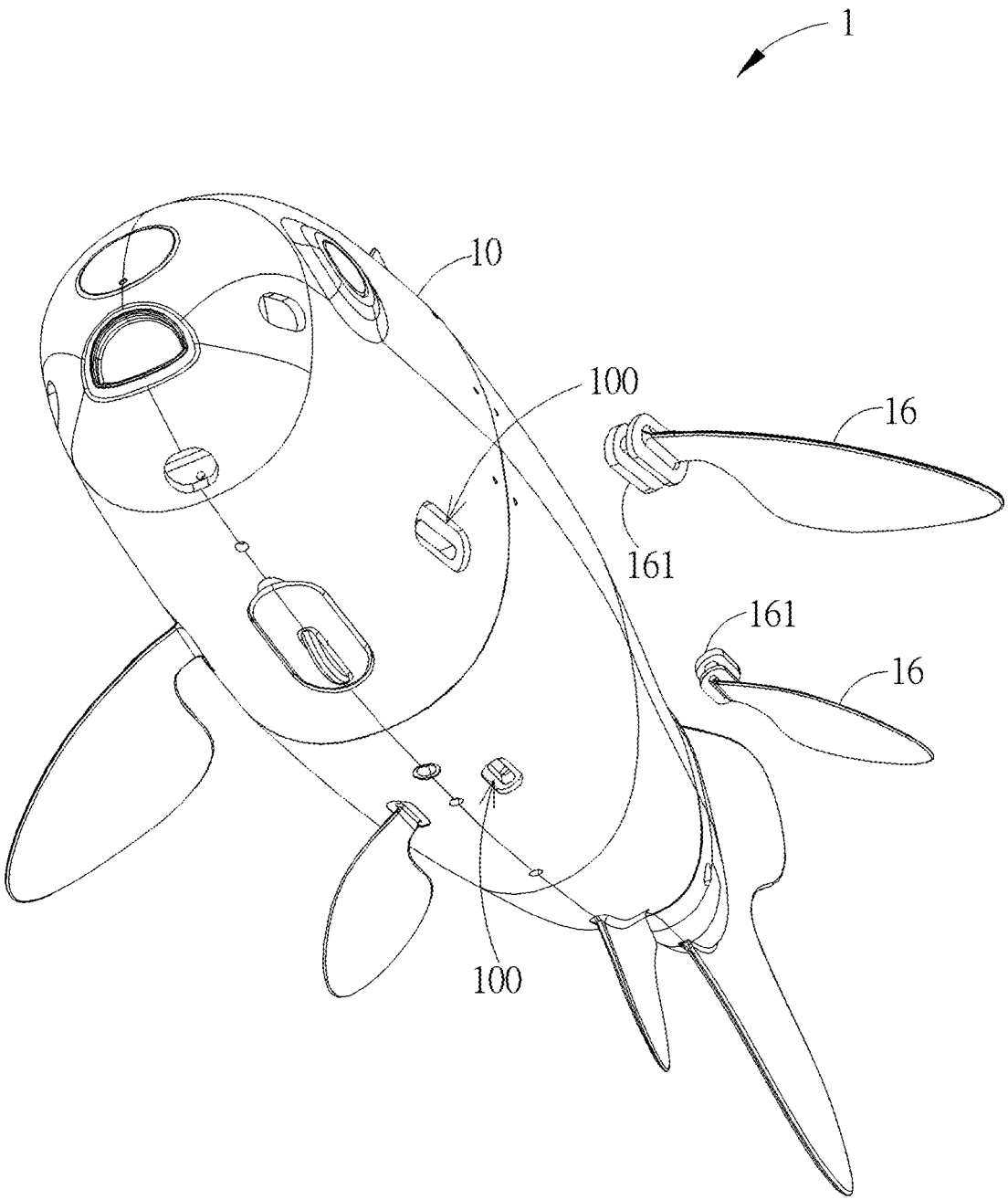
FIG. 16 is a partial exploded view illustrating the underwater device shown in FIG. 1 from another viewing angle.
Figure 17:
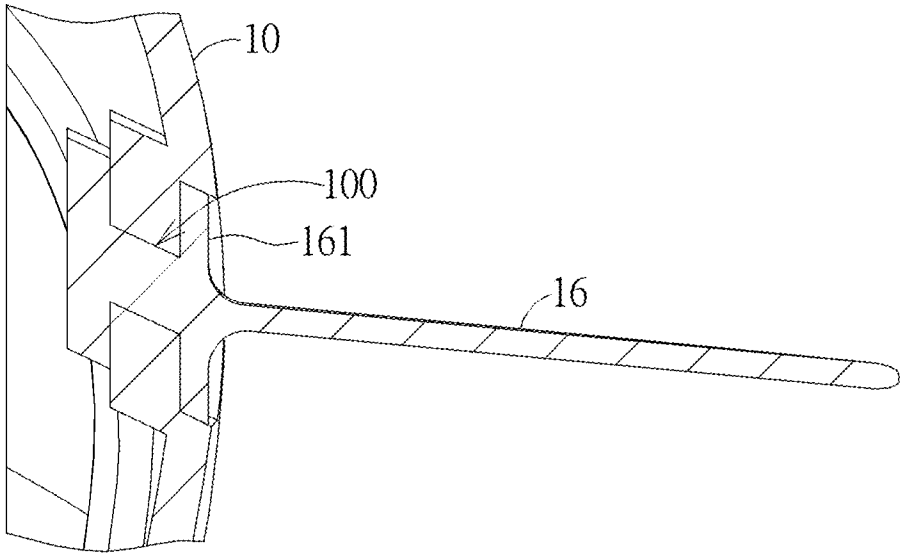
FIG. 17 is a partial sectional view illustrating the outer cover and a fish fin shown in FIG. 16.
Figure 18:
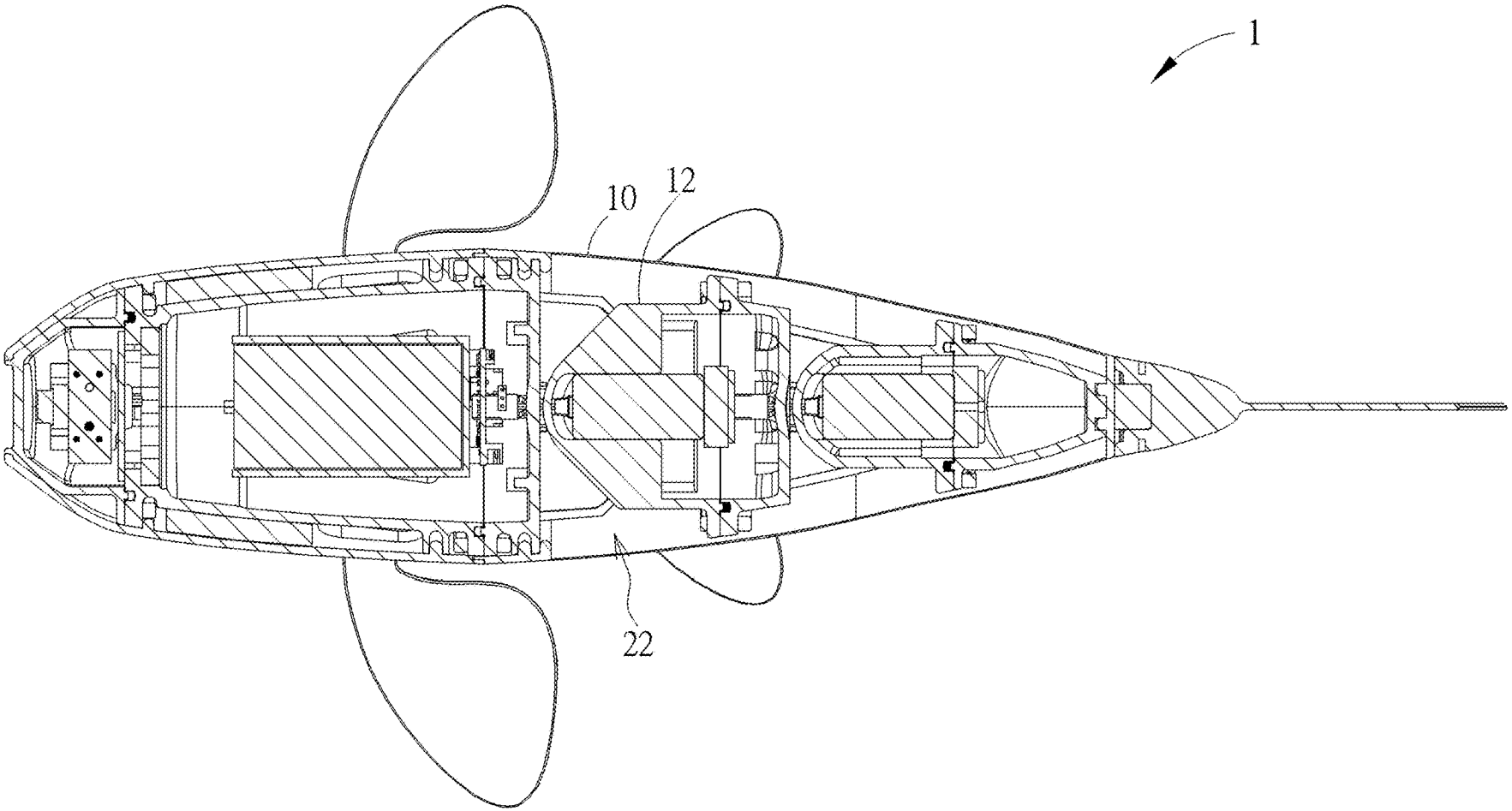
FIG. 18 is a sectional view illustrating the underwater device shown in FIG. 1.
Figure 19:
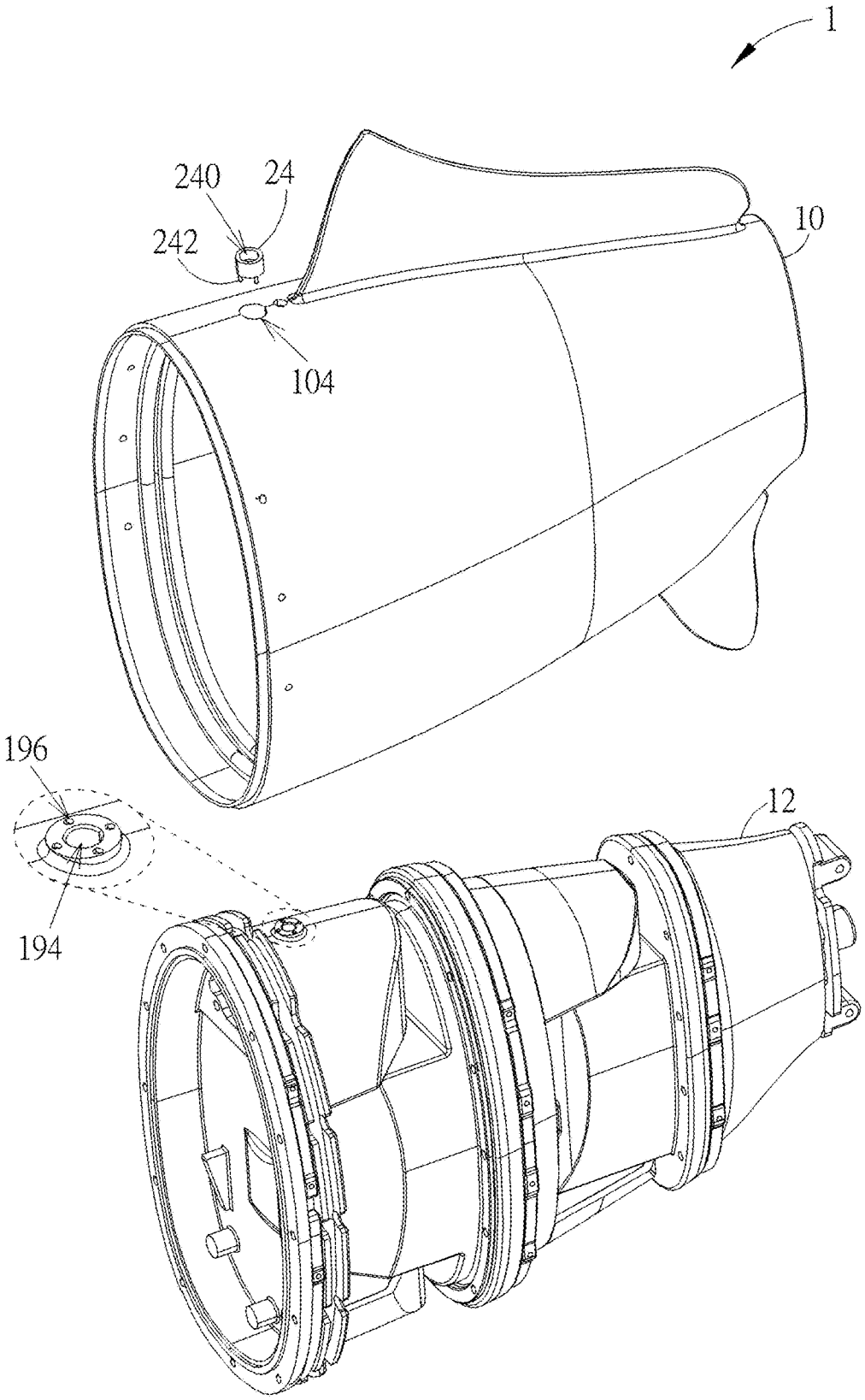
FIG. 19 is a partial exploded view illustrating the underwater device shown in FIG. 1.
Figure 20:
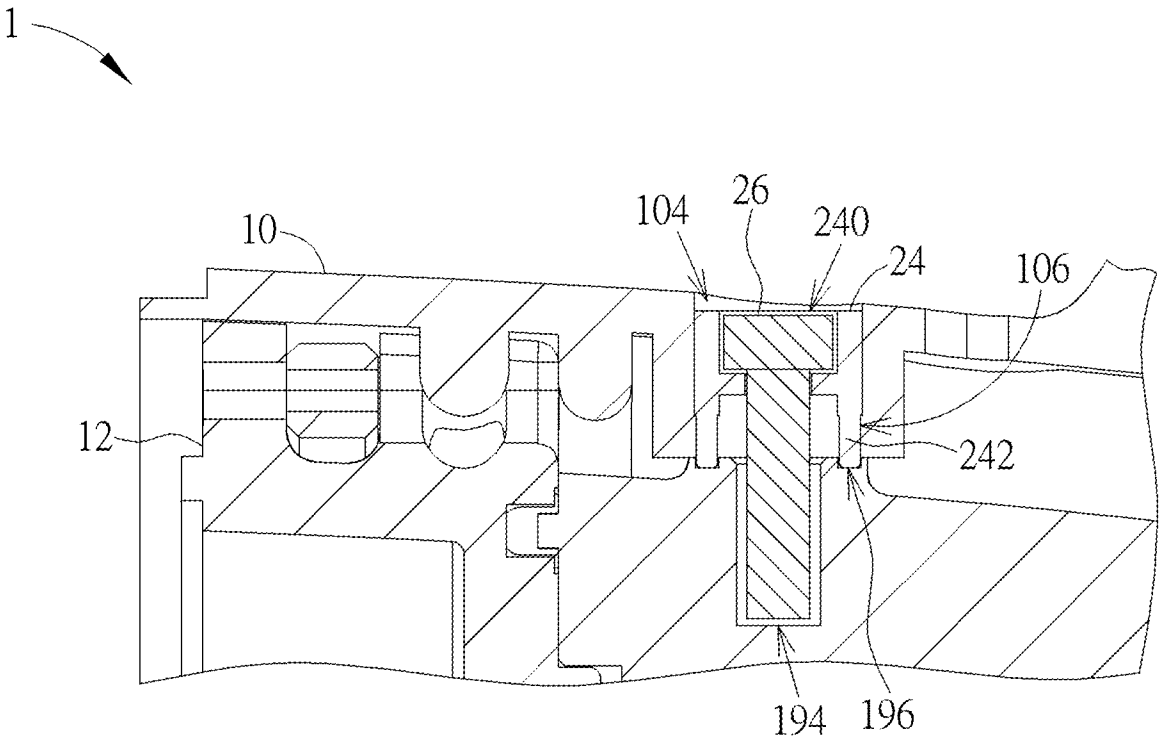
FIG. 20 is a partial sectional view illustrating the underwater device shown in FIG. 1.
Figure 21:
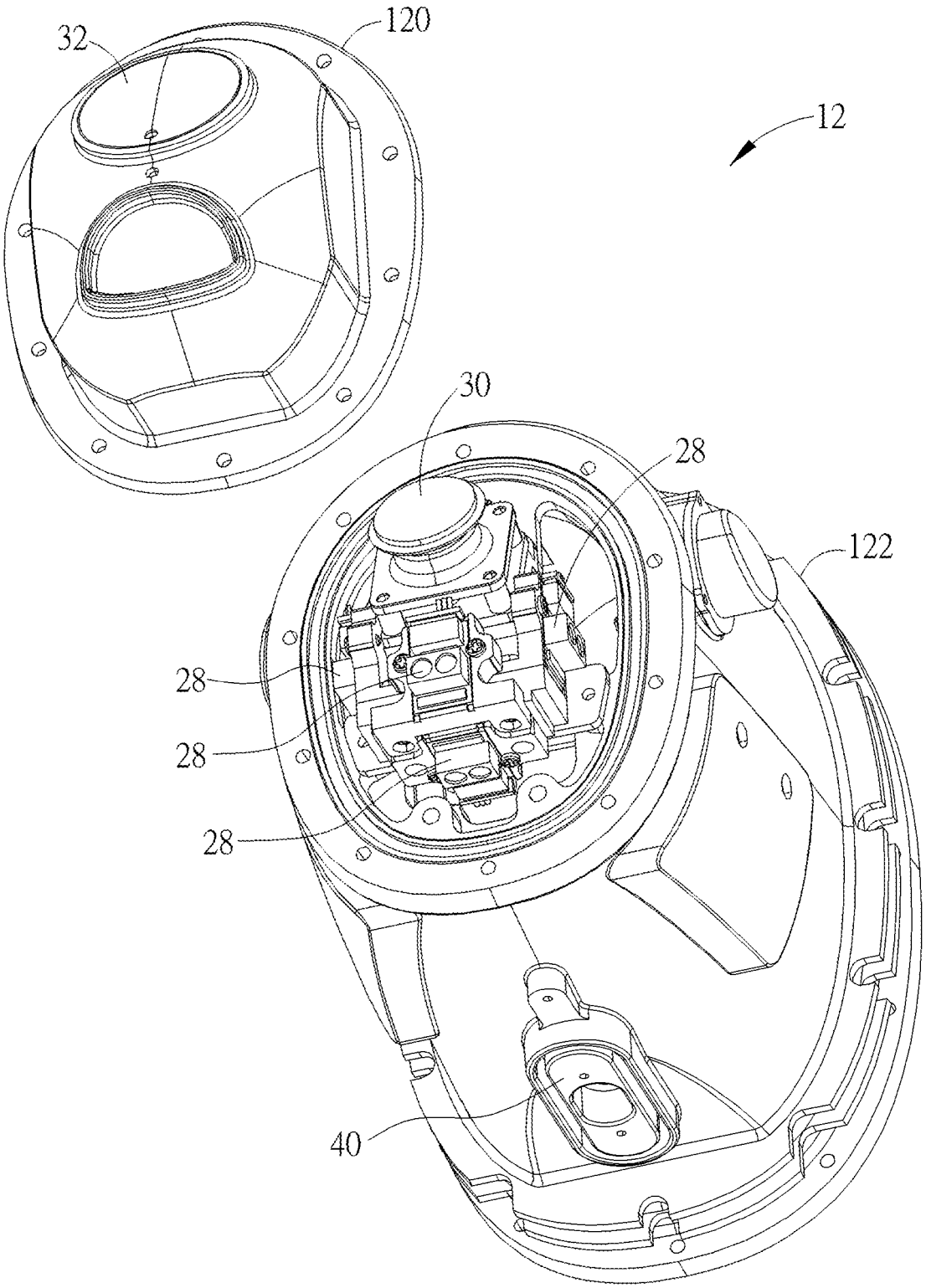
FIG. 21 is a partial exploded view illustrating the main body shown in FIG. 3.
Figure 22:
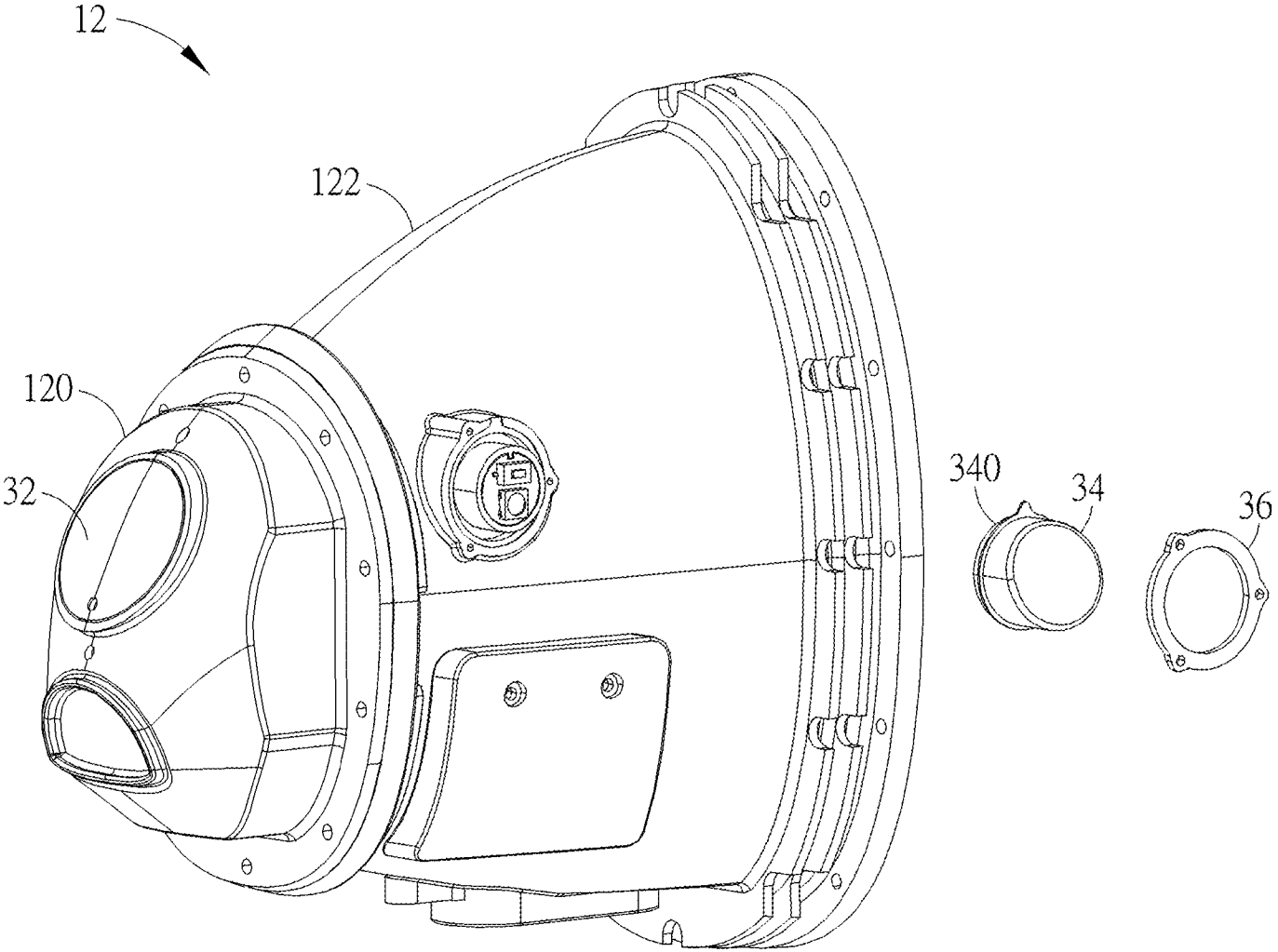
FIG. 22 is a partial exploded view illustrating the main body shown in FIG. 3.

Referring to FIGS. 1 to 22, FIG. 1 is a perspective view illustrating an underwater device 1 according an embodiment of the invention, FIG. 2 is a perspective view illustrating the underwater device 1 shown in FIG. 1, FIG. 3 is a perspective view illustrating the underwater device 1 shown in FIG. 1 without an outer cover 10, FIG. 4 is an exploded view illustrating a main body 12 shown in FIG. 3, FIG. 5 is a partial sectional view illustrating the main body 12 shown in FIG. 3, FIG. 6 is a partial perspective view illustrating the main body 12 shown in FIG. 3 from another viewing angle, FIG. 7 is a perspective view illustrating a center of gravity mechanism 18 shown in FIG. 6, FIG. 8 is a partial exploded view illustrating the center of gravity mechanism 18 shown in FIG. 7, FIG. 9 is a partial perspective view illustrating the main body 12 shown in FIG. 3 from another viewing angle, FIG. 10 is a partial exploded view illustrating the main body 12 shown in FIG. 9 from another viewing angle, FIG. 11 is a perspective view illustrating a first driving mechanism 174 shown in FIG. 9, FIG. 12 is a partial sectional view illustrating the main body 12 shown in FIG. 9, FIG. 13 is another partial sectional view illustrating the main body 12 shown in FIG. 9, FIG. 14 is a perspective view illustrating the main body 12 shown in FIG. 3 connected with a fish tail 14, FIG. 15 is an exploded view illustrating the main body 12 and the fish tail 14 shown in FIG. 14, FIG. 16 is a partial exploded view illustrating the underwater device 1 shown in FIG. 1 from another viewing angle, FIG. 17 is a partial sectional view illustrating the outer cover 10 and a fish fin 16 shown in FIG. 16, FIG. 18 is a sectional view illustrating the underwater device 1 shown in FIG. 1, FIG. 19 is a partial exploded view illustrating the underwater device 1 shown in FIG. 1, FIG. 20 is a partial sectional view illustrating the underwater device 1 shown in FIG. 1, FIG. 21 is a partial exploded view illustrating the main body 12 shown in FIG. 3, and FIG. 22 is a partial exploded view illustrating the main body 12 shown in FIG. 3.

The underwater device 1 of the invention may be, but is not limited to, a bionic fish. The type of the underwater device 1 may be determined according to practical applications. As shown in FIGS. 1 to 3, the underwater device 1 may comprise an outer cover 10, a main body 12, a fish tail 14 and a fish fin 16. The main body 12 is configured to accommodate the main mechanical components and electronic components of the underwater device 1. The outer cover 10 is sleeved on an outside of the main body 12 for decoration. In this embodiment, the outer cover 10 may comprise a fish head cover 10*a* and a fish body cover 10*b*, but the invention is not so limited. Furthermore, the main body 12 may be divided into a fish head section 12*a* and a fish body section 12*b*. The fish head cover 10*a* is sleeved on the fish head section 12*a* and the fish body cover 10*b* is sleeved on the fish body section 12*b*. The fish tail 14 is connected to the fish body section 12*b*. In this embodiment, the underwater device 1 may comprise four fish fins 16, wherein two fish fins 16 serve as pectoral fins and are connected to the fish head section 12*a*, and the other two fish fins 16 serve as ventral fins and are connected to the fish body section 12*b*. In this embodiment, the outer cover 10, the fish tail 14 and the fish fin 16 may be made of silicone, rubber or other soft materials. Accordingly, it may reduce the problem of damage due to impact.

As shown in FIGS. 3 and 4, the fish head section 12*a* of the main body 12 comprises a first casing 120, a second casing 122, a third casing 124, a first sealing ring 126, a second sealing ring 128, a first fixing frame 130, a second fixing frame 132 and a third fixing frame 134. The first sealing ring 126 is sandwiched between the first casing 120 and the second casing 122. The second sealing ring 128 is sandwiched between the second casing 122 and the third casing 124. The first fixing frame 130 is configured to fix the first casing 120 and the second casing 122. The second fixing frame 132 and the third fixing frame 134 are configured to fix the second casing 122 and the third casing 124.

As shown in FIG. 5, the second sealing ring 128 has an outer flange 1280, an inner flange 1282 and a first recess 1284, the second casing 122 has a second recess 1220, and the third casing 124 has a boss 1240. The first recess 1284 of the second sealing ring 128 is located between the outer flange 1280 and the inner flange 1282. The boss 1240 of the third casing 124 may be configured to position the second sealing ring 128. The second sealing ring 128 is embedded in the second recess 1220 of the second casing 122, the boss 1240 of the third casing 124 is embedded in the first recess 1284 of the second sealing ring 128, and the outer flange 1280 and the inner flange 1282 of the second sealing ring 128 are sandwiched between the second casing 122 and the third casing 124. When the second casing 122 and third casing 124 are fixed, three pre-pressure surfaces S1, S2, S3 are formed at positions corresponding to the outer flange 1280, the boss 1240, and the inner flange 1282. A water flow F outside the main body 12 will first be blocked by the pre-pressure surface S1. When the pre-pressure surface S1 fails, the water flow F will be blocked by the pre-pressure surface S2. When the pre-pressure surface S2 also fails, the water flow F will be blocked by the pre-pressure surface S3. Through the design of three pre-pressure surfaces S1, S2, S3, the main body 12 may achieve a highly reliable waterproof function.

As shown in FIG. 5, the second casing 122 may have a first protruding portion 1222 and the third casing 124 may have a second protruding portion 1242. The first protruding portion 1222 abuts against the second protruding portion 1242, the second fixing frame 132 abuts against the first protruding portion 1222, and the third fixing frame 134 abuts against the second protruding portion 1242. A fixing member 136 (e.g. screw) sequentially passes through the second fixing frame 132, the first protruding portion 1222, the second protruding portion 1242 and the third fixing frame 134 to fix the second casing 122 and the third casing 124. In this embodiment, the second fixing frame 132, the first protruding portion 1222 and the second protruding portion 1242 may have through holes without thread for the fixing member 136 to pass through. Furthermore, the third fixing frame 134 may have a screw hole for fixing the fixing member 136. In this embodiment, the second casing 122 and the third casing 124 may be made of plastic, and the second fixing frame 132 and the third fixing frame 134 may be made of metal. Since the fixing member 136 is fixed to the second fixing frame 132 and the third fixing frame 134, a larger fixing torque may be obtained, and the second casing 122 and the third casing 124 are not easily damaged. After fixing the second casing 122 and the third casing 124, the second sealing ring 128 is closer to an inside of the second casing 122 and the third casing 124 than the fixing member 136. Thus, a good waterproof effect may be achieved without waterproofing the fixing member 136.

As shown in FIGS. 3 and 4, the fish body section 12*b* of the main body 12 comprises a fourth casing 138, a fifth casing 140, a sixth casing 142, a first fixing base 144, a seventh casing 146, an eighth casing 148, a ninth casing 150, a tenth casing 152, a second fixing base 154, an eleventh casing 156, a fixing structure 158, a fifth sealing ring 160, a sixth sealing ring 162, a seventh sealing ring 164, an eighth sealing ring 166, a fourth fixing frame 168, a fifth fixing frame 170 and a sixth fixing frame 172.

The fourth casing 138 is fixed to an end of the third casing 124, and the first fixing base 144 is fixed to anther end of the third casing 124. The fifth sealing ring 160 is sandwiched between the third casing 124 and the fourth casing 138. The fifth casing 140 is pivotally connected to the first fixing base 144, and the sixth casing 142 is fixed to the first fixing base 144. The seventh casing 146 is fixed to the fifth casing 140, and the sixth sealing ring 162 is sandwiched between the fifth casing 140 and the seventh casing 146. The eighth casing 148 is fixed to an end of the seventh casing 146, and the second fixing base 154 is fixed to anther end of the seventh casing 146. The seventh sealing ring 164 is sandwiched between the seventh casing 146 and the eighth casing 148. The ninth casing 150 is pivotally connected to the second fixing base 154, and the tenth casing 152 is fixed to the second fixing base 154. The eleventh casing 156 is fixed to the ninth casing 150, and the eighth sealing ring 166 is sandwiched between the ninth casing 150 and the eleventh casing 156. The sixth fixing frame 172 is configured to fix the ninth casing 150 and the eleventh casing 156. The fixing structure 158 is fixed to the eleventh casing 156.

It should be noted that the structural design between all the casings and the sealing rings of the invention may be the same as the structural design between the second casing 122, the third casing 124 and the second sealing ring 128, and will not be described again herein. Furthermore, the fixing manner between all the casings and the fixing frames of the invention may be the same as the fixing manner between the second casing 122, the third casing 124, the second fixing frame 132 and the third fixing frame 134, and will not be described again herein. Moreover, according to practical assembly requirements, the fixing frame may be an open design (e.g. the first fixing frame 130, the second fixing frame 132 and the third fixing frame 134) or a closed design (e.g. the fourth fixing frame 168, the fifth fixing frame 170 and the sixth fixing frame 172).

As shown in FIGS. 6 to 8, the underwater device 1 comprises a center of gravity mechanism 18 disposed in the main body 12. In this embodiment, the center of gravity mechanism 18 may be disposed in the second casing 122. The center of gravity mechanism 18 comprises a fixing plate 180, a bracket 182, a first driving motor 184, two guiding rods 186, two linear bearings 188, a battery module 190 and a transmission assembly 192. The bracket 182 is fixed to the fixing plate 180. The first driving motor 184 is disposed on the bracket 182. The two guiding rods 186 are fixed at two sides of the fixing plate 180. The two linear bearings 188 are disposed on the two guiding rods 186. The battery module 190 is connected to the two linear bearings 188. The transmission assembly 192 is connected to the first driving motor 184 and the battery module 190. The first driving motor 184 may drive the battery module 190 to move along the two guiding rods 186 through the transmission assembly 192 to shift a center of gravity of the underwater device 1, so as to achieve control of floating and diving. Since the battery module 190 moves along the guiding rod 186 through the linear bearing 188, the linear movement of the battery module 190 becomes very smooth, such that the load of the first driving motor 184 becomes smaller and more stable, thereby reducing the failure rate of the first driving motor 184.

In this embodiment, the transmission assembly 192 may comprise a crank 1920, a linkage rod 1922 and a transition plate 1924. The crank 1920 is connected to the first driving motor 184, the transition plate 1924 is connected to the battery module 190, and the linkage rod 1922 is connected to the crank 1920 and the transition plate 1924. Accordingly, the first driving motor 184 may drive the crank 1920 to rotate and the crank 1920 may drive the battery module 190 to move along the two guiding rods 186 through the linkage rod 1922 and the transition plate 1924.

In this embodiment, the battery module 190 may comprise a battery box 1900, a battery 1902 and a baffle 1904. The transition plate 1924 of the transmission assembly 192 is connected to the battery box 1900, and the battery 1902 is disposed in the battery box 1900. The baffle 1904 is fixed to an end of the battery box 1900 to restrain the battery 1902 in the battery box 1900.

As shown in FIGS. 9 to 12, the fish body section 12*b* of the main body 12 comprises a first driving mechanism 174. The first driving mechanism 174 is disposed in the fifth casing 140 and connected to the fourth casing 138. In this embodiment, the first driving mechanism 174 may comprise a second driving motor 1740, a first adapter 1742, a second adapter 1744, a transmission shaft 1746, a shaft sleeve 1748 and a connecting member 1750. The first adapter 1742 is connected to the second driving motor 1740. The second adapter 1744 is connected to the first adapter 1742. The transmission shaft 1746 is connected to the second adapter 1744 and the connecting member 1750. The connecting member 1750 is connected to the fourth casing 138. The shaft sleeve 1748 is sleeved on the transmission shaft 1746. Furthermore, the first driving mechanism 174 may further comprise a bearing 1752, a spacer 1754, a third sealing ring 1756 and a fourth sealing ring 1758. The bearing 1752, the spacer 1754, the third sealing ring 1756 and the fourth sealing ring 1758 are sleeved on the shaft sleeve 1748. In this embodiment, the bearing 1752 may be, but is not limited to, a plastic ball bearing. The third sealing ring 1756 is sandwiched between the shaft sleeve 1748 and the fourth casing 138. The fourth sealing ring 1758 is sandwiched between the spacer 1754 and the fifth casing 140. Still further, the first driving mechanism 174 may further comprise a first support member 1760 and a second support member 1762. The second driving motor 1740 is fixed to the first support member 1760, the first support member 1760 is connected to the second support member 1762, and the second support member 1762 is connected to the fifth casing 140. When an output shaft of the second driving motor 1740 rotates, the first driving mechanism 174 may drive the fifth casing 140 to rotate with respect to the fourth casing 138 and the sixth casing 142, such that the fish body section 12*b* of the main body 12 swings. Since the shaft sleeve 1748 of the first driving mechanism 174 is equipped with the bearing 1752, the spacer 1754, third sealing ring 1756 and the fourth sealing ring 1758, the fish body section 12*b* of the main body 12 may rotate smoothly and waterproof.

As shown in FIGS. 9 and 13, the fish body section 12*b* of the main body 12 may further comprise a second driving mechanism 176. The second driving mechanism 176 is disposed in the ninth casing 150 and connected to the eighth casing 148. The second driving mechanism 176 is configured to drive the ninth casing 150 to rotate with respect to the eighth casing 148 and the tenth casing 152. It should be noted that the structural design of the second driving mechanism 176 may be the same as the structural design of the first driving mechanism 174 and will not be described again herein.

As shown in FIGS. 14 and 15, the fish tail 14 may be fixed to the fixing structure 158 to be connected to the eleventh casing 156. In this embodiment, the underwater device 1 may further comprise a wireless communication module 20. The wireless communication module 20 may be, but is not limited to, a Bluetooth module. The wireless communication module 20 may be disposed in the eleventh casing 156 and fixed to a support member of the second driving mechanism 176. The wireless communication module 20 may transmit signals, such that a user of the underwater device 1 may track the position of the underwater device 1.

As shown in FIGS. 16 to 18, the outer cover 10 is sleeved on an outside of the main body 12 and has an engaging hole 100. In this embodiment, the outer cover 10 may have four engaging holes 100 corresponding to four fish fins 16. The fish fin 16 may have an I-shaped engaging structure 161. The I-shaped engaging structure 161 is engaged in the engaging hole 100 to fix the fish fin 16 to the outer cover 10 and prevent the fish fin 16 from coming off the outer cover 10. Furthermore, an avoidance space 22 may be formed between the outer cover 10 and the main body 12. In other words, the outer cover 10 and the main body 12 do not fit completely. Thus, when the underwater device 1 rotates, the outer cover 10 is not easily tightened, such that the outer cover 10 still maintains better elasticity. Moreover, as shown in FIGS. 1 and 2, the outer cover 10 is formed with a plurality of water holes 102. Water may enter the avoidance space 22 through the water holes 102, such that the internal and external pressure of the outer cover 10 may be balanced and the outer cover 10 will not be easily crushed.

As shown in FIGS. 19 and 20, the underwater device 1 may further comprise an anti-loosening component 24 and a screw 26, the outer cover 10 may have an installation hole 104 and a plurality of first restraining holes 106, and the main body 12 may have a screw hole 194 and a plurality of second restraining holes 196. Furthermore, the anti-loosening component 24 may have a through hole 240 and a plurality of restraining portions 242. The plurality of restraining portions 242 may sequentially pass through the plurality of first restraining holes 106 and the plurality of second restraining holes 196 to install the anti-loosening component 24 in the installation hole 104. The screw 26 passes though the through hole 240 to be fixed to the screw hole 194. Accordingly, the outer cover 10 may be prevented from being easily pulled away from the main body 12. In an embodiment, the screw hole 194 may be provided by a copper post, but the invention is not so limited.

As shown in FIGS. 3 and 21, the underwater device 1 may further comprise four infrared sensors 28 disposed in the first casing 120. The positions of the four infrared sensors 28 correspond to the front, bottom, left and right sides of the main body 12 respectively, such that the four infrared sensors 28 may be configured to detect obstacles in front, left and right of the underwater device 1 and detect whether the underwater device 1 has dived to the bottom. When an obstacle is detected, the underwater device 1 may be controlled to make avoidance actions in advance. When it is detected that the underwater device 1 has dived to the bottom, the underwater device 1 may be controlled to float up. In this embodiment, an avoidance hole 108 corresponding to the infrared sensor 28 (as shown in FIG. 1) may be formed on the outer cover 10 to avoid affecting the signal transmission of the infrared sensor 28. Furthermore, the underwater device 1 may further comprise a camera lens 30 disposed in the first casing 120 and located above the four infrared sensors 28. In this embodiment, a transparent lens cover 32 may be disposed on the first casing 120 at a position corresponding to the camera lens 30.

As shown in FIGS. 3 and 22, the underwater device 1 may further comprise a fish eye cover 34 and a fixing sheet 36. The fish eye cover 34 may be disposed on the second casing 22 and has a fixing flange 340. The fixing flange 340 is sandwiched between the fixing sheet 36 and the second casing 122 to achieve high reliability waterproof function.

As shown in FIG. 15, the underwater device 1 may further comprise an airtight test hole 38 disposed on the eleventh casing 156 of the main body 12. Before entering water, it is convenient for the underwater device 1 to perform an airtight test to confirm that there is no air leakage. Furthermore, as shown in FIGS. 2 and 21, the underwater device 1 may further comprise an electrical connector 40 and a waterproof cover 42. The waterproof cover 42 covers the electrical connector 40 to prevent the electrical connector 40 from being damaged by water.

As mentioned in the above, the invention utilizes the first driving motor of the center of gravity mechanism to drive the battery module to move to shift the center of gravity of the underwater device, so as to achieve control of floating and diving. Since the battery module moves along the guiding rod through the linear bearing, the linear movement of the battery module becomes very smooth, such that the load of the first driving motor becomes smaller and more stable, thereby reducing the failure rate of the first driving motor. The invention may achieve waterproof requirements through the arrangement of multiple sealing rings. In an embodiment, the underwater device may be a bionic fish. The driving mechanism is equipped with the bearing, the spacer and the sealing ring on the shaft sleeve, which allows the fish body section of the bionic fish to rotate smoothly and waterproof. In an embodiment, the positions of four infrared sensors correspond to the front, bottom, left and right sides of the main body respectively, such that the four infrared sensors may be configured to detect obstacles in front, left and right of the underwater device and detect whether the underwater device has dived to the bottom.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An underwater device comprising:

a main body; and a center of gravity mechanism disposed in the main body, the center of gravity mechanism comprising:

a fixing plate;

a bracket fixed to the fixing plate;

a first driving motor disposed on the bracket;

two guiding rods fixed at two sides of the fixing plate;

two linear bearings disposed on the two guiding rods;

a battery module connected to the two linear bearings; and a transmission assembly connected to the first driving motor and the battery module;

wherein the first driving motor drives the battery module to move along the two guiding rods through the transmission assembly to shift a center of gravity of the underwater device.

2. The underwater device of claim 1, wherein the transmission assembly comprises a crank, a linkage rod and a transition plate, the crank is connected to the first driving motor, the transition plate is connected to the battery module, and the linkage rod is connected to the crank and the transition plate.

3. The underwater device of claim 1, wherein the battery module comprises a battery box, a battery and a baffle, the transmission assembly is connected to the battery box, the battery is disposed in the battery box, and the baffle is fixed to an end of the battery box to restrain the battery in the battery box.

4. The underwater device of claim 1, wherein the underwater device is a bionic fish, a fish head section of the main body comprises a first casing, a second casing, a third casing, a first sealing ring, a second sealing ring, a first fixing frame, a second fixing frame and a third fixing frame, the first sealing ring is sandwiched between the first casing and the second casing, the second sealing ring is sandwiched between the second casing and the third casing, the first fixing frame is configured to fix the first casing and the second casing, the second fixing frame and the third fixing frame are configured to fix the second casing and the third casing, and the center of gravity mechanism is disposed in the second casing.

5. The underwater device of claim 4, wherein the second sealing ring has an outer flange, an inner flange and a first recess, the first recess is located between the outer flange and the inner flange, the second casing has a second recess, the third casing has a boss, the second sealing ring is embedded in the second recess, the boss is embedded in the first recess, and the outer flange and the inner flange are sandwiched between the second casing and the third casing.

6. The underwater device of claim 4, wherein the second casing has a first protruding portion, the third casing has a second protruding portion, the first protruding portion abuts against the second protruding portion, the second fixing frame abuts against the first protruding portion, the third fixing frame abuts against the second protruding portion, a fixing member sequentially passes through the second fixing frame, the first protruding portion, the second protruding portion and the third fixing frame to fix the second casing and the third casing, and the second sealing ring is closer to an inside of the second casing and the third casing than the fixing member.

7. The underwater device of claim 4, further comprising four infrared sensors disposed in the first casing, wherein positions of the four infrared sensors correspond to front, bottom, left and right sides of the main body respectively.

8. The underwater device of claim 7, further comprising a camera lens disposed in the first casing and located above the four infrared sensors.

9. The underwater device of claim 4, further comprising a fish eye cover and a fixing sheet, wherein the fish eye cover is disposed on the second casing and has a fixing flange, and the fixing flange is sandwiched between the fixing sheet and the second casing.

10. The underwater device of claim 4, wherein a fish body section of the main body comprises a fourth casing, a fifth casing, a sixth casing, a first fixing base and a first driving mechanism, the fourth casing is fixed to the third casing, the first fixing base is fixed to the third casing, the fifth casing is pivotally connected to the first fixing base, the sixth casing is fixed to the first fixing base, the first driving mechanism is disposed in the fifth casing and connected to the fourth casing, and the first driving mechanism is configured to drive the fifth casing to rotate with respect to the fourth casing and the sixth casing.

11. The underwater device of claim 10, wherein the first driving mechanism comprises a second driving motor, a first adapter, a second adapter, a transmission shaft, a shaft sleeve and a connecting member, the first adapter is connected to the second driving motor, the second adapter is connected to the first adapter, the transmission shaft is connected to the second adapter and the connecting member, the connecting member is connected to the fourth casing, and the shaft sleeve is sleeved on the transmission shaft.

12. The underwater device of claim 11, wherein the first driving mechanism further comprises a bearing, a spacer, a third sealing ring and a fourth sealing ring, the bearing, the spacer, the third sealing ring and the fourth sealing ring are sleeved on the shaft sleeve, the third sealing ring is sandwiched between the shaft sleeve and the fourth casing, and the fourth sealing ring is sandwiched between the spacer and the fifth casing.

13. The underwater device of claim 11, wherein the first driving mechanism further comprises a first support member and a second support member, the second driving motor is fixed to the first support member, the first support member is connected to the second support member, and the second support member is connected to the fifth casing.

14. The underwater device of claim 10, wherein the fish body section of the main body comprises a seventh casing, an eighth casing, a ninth casing, a tenth casing, a second fixing base and a second driving mechanism, the seventh casing is fixed to the fifth casing, the eighth casing is fixed to the seventh casing, the second fixing base is fixed to the seventh casing, the ninth casing is pivotally connected to the second fixing base, the tenth casing is connected to the second fixing base, the second driving mechanism is disposed in the ninth casing and connected to the eighth casing, and the second driving mechanism is configured to drive the ninth casing to rotate with respect to the eighth casing and the tenth casing.

15. The underwater device of claim 14, further comprising an eleventh casing and a wireless communication module, wherein the eleventh casing is connected to the ninth casing, and the wireless communication module is disposed in the eleventh casing and fixed to the second driving mechanism.

16. The underwater device of claim 15, further comprising a fixing structure and a fish tail, wherein the fixing structure is fixed to the eleventh casing, and the fish tail is fixed to the fixing structure.

17. The underwater device of claim 1, further comprising an outer cover and a fish fin, wherein the outer cover is sleeved on an outside of the main body and has an engaging hole, the fish fin has an I-shaped engaging structure, and the I-shaped engaging structure is engaged in the engaging hole to fix the fish fin to the outer cover.

18. The underwater device of claim 17, wherein an avoidance space is formed between the outer cover and the main body.

19. The underwater device of claim 17, further comprising an anti-loosening component and a screw, wherein the outer cover has an installation hole and a plurality of first restraining holes, the main body has a screw hole and a plurality of second restraining holes, the anti-loosening component has a through hole and a plurality of restraining portions, the plurality of restraining portions sequentially passes through the plurality of first restraining holes and the plurality of second restraining holes to install the anti-loosening component in the installation hole, and the screw passes though the through hole to be fixed to the screw hole.

* * * * *